US008516663B2

(12) United States Patent
Stoehr

(10) Patent No.: US 8,516,663 B2
(45) Date of Patent: Aug. 27, 2013

(54) CUFFLINK TECHNOLOGY

(75) Inventor: Kyle C. Stoehr, Waukesha, WI (US)

(73) Assignee: Hollenwolff, LLC, Waukesha, WI (US)

( * ) Notice: Subject to any disclaimer, the term of this patent is extended or adjusted under 35 U.S.C. 154(b) by 256 days.

(21) Appl. No.: 12/778,367

(22) Filed: May 12, 2010

(65) Prior Publication Data

US 2011/0277213 A1 Nov. 17, 2011

(51) Int. Cl.
*A41B 7/00* (2006.01)
*A44B 5/00* (2006.01)

(52) U.S. Cl.
USPC ..... 24/102 SL; 24/41.1; 24/47; 24/102 FC; 24/104; 24/106; 24/108; 24/114.11

(58) Field of Classification Search
USPC ..... 24/41.1, 47, 102 SL, 102 FC, 104, 24/106, 108, 114.11
See application file for complete search history.

(56) References Cited

U.S. PATENT DOCUMENTS

| | | | | |
|---|---|---|---|---|
| 313,084 | A | 3/1885 | Kullmann | |
| 464,808 | A | 12/1891 | Bonner | |
| 686,193 | A | 11/1901 | Bailey | |
| 818,530 | A | 4/1906 | Fischer | |
| 922,476 | A | 5/1909 | Henderson | |
| 1,044,354 | A | 11/1912 | Collett | |
| 1,137,789 | A * | 5/1915 | Presby | 24/95 |
| 1,183,422 | A | 5/1916 | Anderson | |
| 1,323,699 | A | 12/1919 | Kochenkoff | |
| 1,337,889 | A | 4/1920 | Doran et al. | |
| 1,340,515 | A | 5/1920 | Anderson | |
| 1,341,130 | A | 5/1920 | Jacobs | |
| 1,346,039 | A | 7/1920 | McRae | |
| 1,352,908 | A | 9/1920 | Matteson | |
| 1,353,085 | A | 9/1920 | Swedlund | |
| 1,367,154 | A | 2/1921 | Lapinski | |
| 1,369,926 | A | 3/1921 | Kahn | |
| 1,375,581 | A * | 4/1921 | Fontaine | 24/102 SL |
| 1,379,192 | A | 5/1921 | Larter | |
| 1,380,268 | A | 5/1921 | Sullivan | |
| 1,382,123 | A | 6/1921 | Sabourin | |
| 1,388,522 | A | 8/1921 | Lyons | |
| 1,390,255 | A * | 9/1921 | Wilson | 24/102 SL |

(Continued)

FOREIGN PATENT DOCUMENTS

| | | |
|---|---|---|
| FR | 693831 | 11/1930 |
| FR | 1032126 | 6/1953 |
| WO | 2009027734 | 3/2009 |

OTHER PUBLICATIONS

Partial International Search Report, dated Jul. 22, 2011 for PCT Application No. PCT/US2011/036040, 2 pages.

(Continued)

*Primary Examiner* — Robert J Sandy
*Assistant Examiner* — David Upchurch
(74) *Attorney, Agent, or Firm* — Fredrikson & Byron, PA

(57) ABSTRACT

Various cufflink embodiments are provided. In some embodiments, the cufflink has opposed first and second heads that are releasably locked relative to each other. In some embodiments, the opposed first and second heads can be locked releasably in multiple positions with respect to each another. In other embodiments, a stud or cufflink includes a removable decorative insert. In certain embodiments, a cufflink includes a retention structure configured to temporarily retain part of the cufflink on a shirt cuff. Some embodiments provide a cufflink having an actuator protected against inadvertent actuation.

40 Claims, 20 Drawing Sheets

(56) References Cited

U.S. PATENT DOCUMENTS

| | | | |
|---|---|---|---|
| 1,404,247 | A | 1/1922 | Swedlund |
| 1,409,010 | A | 3/1922 | Kantor |
| 1,409,514 | A | 3/1922 | Aymar |
| 1,450,344 | A | 4/1923 | Wilde |
| 1,455,281 | A | 5/1923 | Baer |
| 1,461,009 | A | 7/1923 | Chabot |
| 1,462,332 | A | 7/1923 | Fried |
| 1,466,990 | A | 9/1923 | Cooper |
| 1,471,809 | A | 10/1923 | Schmid |
| 1,475,750 | A | 11/1923 | Cloutier |
| 1,513,771 | A | 11/1923 | Tannenbaum |
| 1,478,128 | A | 12/1923 | Lyons |
| 1,480,755 | A | 1/1924 | Gammell |
| 1,481,083 | A | 1/1924 | Carrier |
| 1,481,932 | A | 1/1924 | Skoog |
| 1,507,249 | A | 1/1924 | Ormsbee |
| 1,492,366 | A | 4/1924 | Fox et al. |
| 1,516,852 | A | 11/1924 | Gwilliam |
| 1,525,403 | A | 2/1925 | Lieber |
| 1,536,210 | A | 5/1925 | Greene |
| 1,551,051 | A | 8/1925 | Pollard |
| D68,266 | S | 9/1925 | McClellan |
| 1,563,127 | A | 11/1925 | Wilde |
| 1,536,350 | A | 12/1925 | Field et al. |
| 1,563,974 | A | 12/1925 | Forsell |
| 1,564,657 | A | 12/1925 | Wullum |
| 1,566,023 | A | 12/1925 | Kuehner |
| 1,592,663 | A | 7/1926 | Hallihan |
| 1,593,887 | A | 7/1926 | Tannenbaum |
| D70,769 | S | 8/1926 | Ormsbee |
| D70,893 | S | 8/1926 | Ormsbee |
| 1,595,656 | A | 8/1926 | Hallihan |
| 1,610,349 | A | 12/1926 | Zweigenbaum |
| 1,627,460 | A | 5/1927 | Roberts |
| D74,696 | S | 3/1928 | Ormsbee |
| 1,686,235 | A | 10/1928 | Heasley |
| 1,701,461 | A | 2/1929 | Graham |
| 1,720,079 | A | 7/1929 | Kenlan |
| 1,757,369 | A | 5/1930 | Humphries |
| 1,777,349 | A | 10/1930 | Cantone |
| 1,803,988 | A | 5/1931 | Alm |
| 1,823,229 | A | 9/1931 | Balbaud |
| 1,849,672 | A | 3/1932 | Jansson |
| 1,924,791 | A | 8/1933 | Hyman |
| 1,959,092 | A | 5/1934 | Clark |
| 1,993,717 | A | 3/1935 | Hemmerich |
| 1,999,034 | A | 4/1935 | Clark |
| 2,013,465 | A | 9/1935 | Johnson |
| 2,064,947 | A | 12/1936 | Rique |
| 2,139,308 | A | 12/1938 | Kauffman |
| 2,145,211 | A | 1/1939 | Dixon |
| 2,184,230 | A | 12/1939 | Sudmann |
| 2,188,505 | A | 1/1940 | Garrigus |
| 2,206,082 | A | 7/1940 | Ellsasser |
| 2,225,889 | A | 12/1940 | Rubenstein |
| 2,512,075 | A | 6/1950 | Schwartz |
| 2,544,876 | A | 3/1951 | Bowder |
| 2,597,216 | A | 5/1952 | Wylie |
| 2,600,894 | A | 6/1952 | Marien |
| 2,658,249 | A | 11/1953 | Wilson |
| 2,713,707 | A | 7/1955 | Libby |
| 2,733,579 | A | 2/1956 | Pfeffer et al. |
| 2,793,415 | A | 5/1957 | Respini |
| 2,799,069 | A | 7/1957 | Marien |
| 2,834,080 | A | 5/1958 | Corbi |
| 2,860,395 | A | 11/1958 | Anderson |
| 2,869,202 | A | 1/1959 | Buckingham |
| 2,901,797 | A | 9/1959 | Wyatt |
| 3,144,692 | A | 8/1964 | Espino |
| 3,248,766 | A | 5/1966 | Green |
| 3,249,974 | A | 5/1966 | Connolly |
| 3,350,802 | A | 11/1967 | Segel |
| 3,535,747 | A | 10/1970 | Benn |
| 3,538,556 | A | 11/1970 | Shein |
| 3,646,642 | A | 3/1972 | Sitt |
| 3,858,280 | A * | 1/1975 | Martens ..... 70/57.1 |
| 4,170,808 | A | 10/1979 | Knowles |
| D263,765 | S | 4/1982 | Engelhardt |
| 4,608,838 | A | 9/1986 | Gardner |
| 4,869,789 | A | 9/1989 | Kurze et al. |
| 4,935,268 | A | 6/1990 | Poll |
| 5,077,988 | A | 1/1992 | Poll |
| 5,375,301 | A | 12/1994 | Schindler |
| D377,919 | S | 2/1997 | Singer et al. |
| 6,087,018 | A | 7/2000 | Uchiyama |
| 6,116,054 | A | 9/2000 | Czupor |
| 6,415,629 | B1 | 7/2002 | Chan |
| 6,588,067 | B2 | 7/2003 | Efron et al. |
| 6,594,871 | B2 | 7/2003 | Hoffman |
| 6,629,434 | B2 | 10/2003 | Chia et al. |
| 6,800,326 | B1 | 10/2004 | Uchiyama |
| D537,754 | S | 3/2007 | Flores |
| 7,409,837 | B2 | 8/2008 | Smith |
| D584,186 | S | 1/2009 | Levin |
| 2004/0103689 | A1 | 6/2004 | Chia et al. |
| 2008/0250815 | A1 | 10/2008 | Wachler et al. |
| 2008/0289152 | A1 | 11/2008 | Surratt |
| 2009/0144946 | A1 | 6/2009 | Morishita et al. |

OTHER PUBLICATIONS www.rolanditen.com/collection-cufflinks-pirouette.php, 2009, 2 pages.

Hublot Genéve Cufflinks, www.facebook.com/video/video.php?v=1187947893200, Jul. 22, 2009, 1 sample page attached.

girard-perregaux cufflinks, www.girard-perregaux.ch/collection/collection-en.aspx?type=5&id=19, accessed online Aug. 19, 2011, 2 pages.

Milus Cufflinks, www.milus.com/en/accessories-gent/cufflinks-cuf311, accessed online Aug. 19, 2011, 1 page.

BRM Cufflinks, http://www.neimanmarcus.com/store/catalog/prod.jhtml?itemId=prod61140001&eItemId=prod61140001&parentId=cat9560735, 1 page, dated Aug. 19, 2011.

International Search Report and Written Opinion, PCT/US2011/036040, Dec. 16, 2011, 24 pages.

Photo of "Ball Lock Cufflink Jan. 29-24," 1 page.

* cited by examiner

CUFFLINK TECHNOLOGY

FIELD OF THE INVENTION

The invention relates generally to jewelry. More particularly, the invention relates to cufflinks and studs for attachment to shirts.

BACKGROUND OF THE INVENTION

Myriad different cufflinks have been used on shirts. Notwithstanding all the cufflink variants that have been proposed, there remain many cufflink features that could be improved.

Some cufflinks have mechanical locking mechanisms that allow two separable halves to be selectively locked or unlocked. The durability of those locking mechanisms, however, has in some cases been less than ideal. For example, the ability of the locking mechanism to hold the halves together may deteriorate over time. If such a mechanism fails, then the cufflink will typically fall off the shirt, at which point it may be lost. Thus, there is a need for cufflinks that have a durable locking mechanism.

Further, certain cufflinks have a locking mechanism with an actuator that is vulnerable to be inadvertently actuated. In such cases, if the actuator is accidentally operated while the cufflink is mounted on a shirt, then the cufflink may fall off the shirt and be lost.

Still further, some cufflinks have the ability to expand when mounted on a shirt. This expansion can provide more clearance space within the cuff of the shirt. This may be convenient, for example, if the wearer has on a large watch or the like. However, some of these cufflinks are designed in way that leaves them vulnerable to falling off the shirt. And because they are expandable, they are not positively locked in any fixed configuration. It would be desirable to provide a cufflink (e.g., a double-sided cufflink) that can be positively locked in different configurations, each providing a different amount of clearance space within the cuff of the shirt on which it is mounted. It would be particularly desirable to provide a cufflink of this nature that, when locked, is prevented from falling off the shirt.

Further yet, some cufflinks and studs have removable decorative pieces. However, it would be desirable to provide simple, reliable methods for providing a cufflink or stud with a removable decorative piece. Such a cufflink or stud may, for example, be fitted with decorative pieces of different appearance (e.g., of different colors), as desired (e.g., to complement the wearer's clothing, accessories, or both). It would be desirable to provide a cufflink or stud of this nature where the decorative piece can be removed easily and without damaging it or the cufflink or stud.

Finally, it would be desirable to provide cufflinks (e.g., double-sided cufflinks) and studs of appealing ornamental design, having a durable construction, and being easy to use (e.g., easy to mount on a shirt).

SUMMARY

In certain embodiments, the invention provides a cufflink having opposed first and second heads. A shaft projects from the first head to a distal end region that is locked releasably to the second head. A plunger is mounted for axial movement within and relative to the shaft. The plunger has a distal end adjacent to which a shoulder stop is provided. The shoulder stop prevents movement of the plunger in a first axial direction when the shoulder stop engages a stop surface of the shaft's distal end region.

Some embodiments of the invention provide a cufflink having first and second segments that are locked together releasably. The first segment comprises a first head, and the second segment comprises a second head. The first segment includes a first neck region projecting from the first head to a first distal end region. A plunger is mounted for axial movement within and relative to the first neck region. The plunger has a distal end adjacent to which a shoulder stop is provided. The shoulder stop prevents movement of the plunger in a first axial direction when the shoulder stop engages a stop surface defined by the cufflink's first segment.

Certain embodiments of the invention provide an adjustable cufflink and shirt cuff combination. The present combination includes a shirt cuff having a set of four cuff holes and a cufflink comprising a first head and a second head. In the present embodiments, the first and second heads of the cufflink are each too large to pass through any one of the four cuff holes. The adjustable cufflink has a separated configuration in which the first and second heads are in a detached state. In these embodiments, the cufflink has a locking mechanism configured to releasably lock the first and second heads in either of two positions. The first and second heads when locked in a first position are closer together than when they are locked in a second position, such that when the heads are locked in the second position the shirt cuff provides more internal clearance space than when the heads are locked in the first position. Preferably, when the heads are locked in either position the locking mechanism prevents the heads from moving significantly toward or away from each other.

In certain embodiments, the invention provides a cufflink comprising a first head from which projects a shaft configured to extend through four aligned cuff holes in a cuff. In the present embodiments, the shaft has a retention structure configured to temporarily retain the shaft and first head on the cuff such that two cuff end regions respectively defining the four cuff holes are retained between the retention structure and the first head. The cufflink includes a second head having a recess that extends through the second head. In the present embodiments, the shaft has a distal end region configured to be locked releasably within the recess of the second head.

Some embodiments provide a cufflink comprising first and second heads configured to be releasably locked in a conjoint configuration by a mechanical lock mechanism. The present cufflink includes an actuator to selectively lock and unlock the mechanical lock mechanism. In these embodiments, the actuator is configured to move between locked and unlocked positions, and the first head comprises a raised wall configured to protect the actuator from inadvertent actuation. The actuator here is configured to move relative to the raised wall during locking and unlocking of the lock mechanism, and the first head bounds a finger clearance space between the raised wall and the actuator.

In certain embodiments, the invention provides a decorative cufflink or stud assembly. The present cufflink or stud has first and second enlarged heads and a central neck. In the present embodiments, the first head defines a pocket in which is received a removable decorative insert. The removable decorative insert is retained removably within the pocket by a resilient retention member and defines a decorative face. The resilient retention member preferably is disposed between an interior wall bounding the pocket and an exterior wall of the removable decorative insert. An insert removal access bore is provided, preferably so as to extend from the pocket defined by the first head through the central neck and opening through a desired face of the second head. The desired face of the second head and the decorative face of the insert can be generally opposed.

BRIEF DESCRIPTION OF THE DRAWINGS

The following drawings are illustrative of particular embodiments of the present invention and therefore do not limit the scope of the invention. The drawings are not necessarily to scale and are intended for use in conjunction with the explanations in the following detailed description. Embodiments of the present invention will hereinafter be described in conjunction with the appended drawings, wherein like numerals denote like elements.

DETAILED TECHNICAL DESCRIPTION

Figure 1:
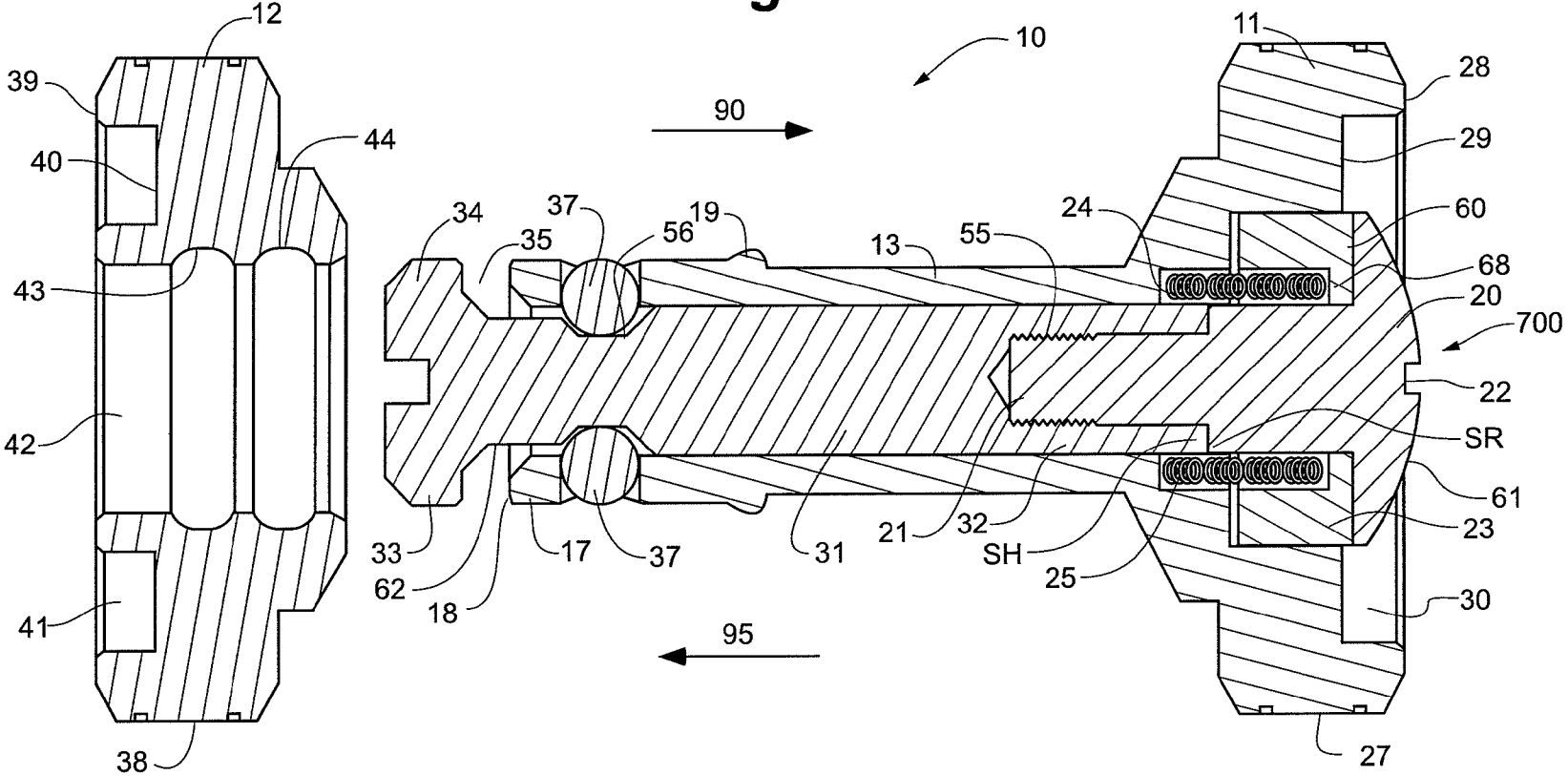
FIG. 1 illustrates a cross-sectional side view of a cufflink in accordance with a first embodiment, wherein the cufflink has first and second heads, these heads being shown in a separated configuration.

The following detailed description is exemplary in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of skill in the field of the invention. Those skilled in the art will recognize that many of the examples given have suitable alternatives.

The invention provides a variety of cufflink (e.g., double-sided cufflink) and stud embodiments. Certain embodiments provide a cufflink having first and second segments that can be locked together releasably (e.g., by a mechanical locking mechanism). The first segment comprises a first head 11, 111 and the second segment comprises a second head 12, 112. In embodiments like that shown in FIGS. 1-5, the first segment of the cufflink includes the first head 11 and a shaft or neck 13 projecting from the first head, while the second segment of the cufflink is formed by the cufflink's second head 12. In embodiments like that shown in FIGS. 6-10, the first segment (or "first half") includes the first head 111 and a first neck region or shaft 113 projecting from the first head, and the second segment (or "second half") includes the second head 112 and a second neck region or shaft 146 projecting from the second head. Some exemplary embodiments will now be described.

Figure 2:
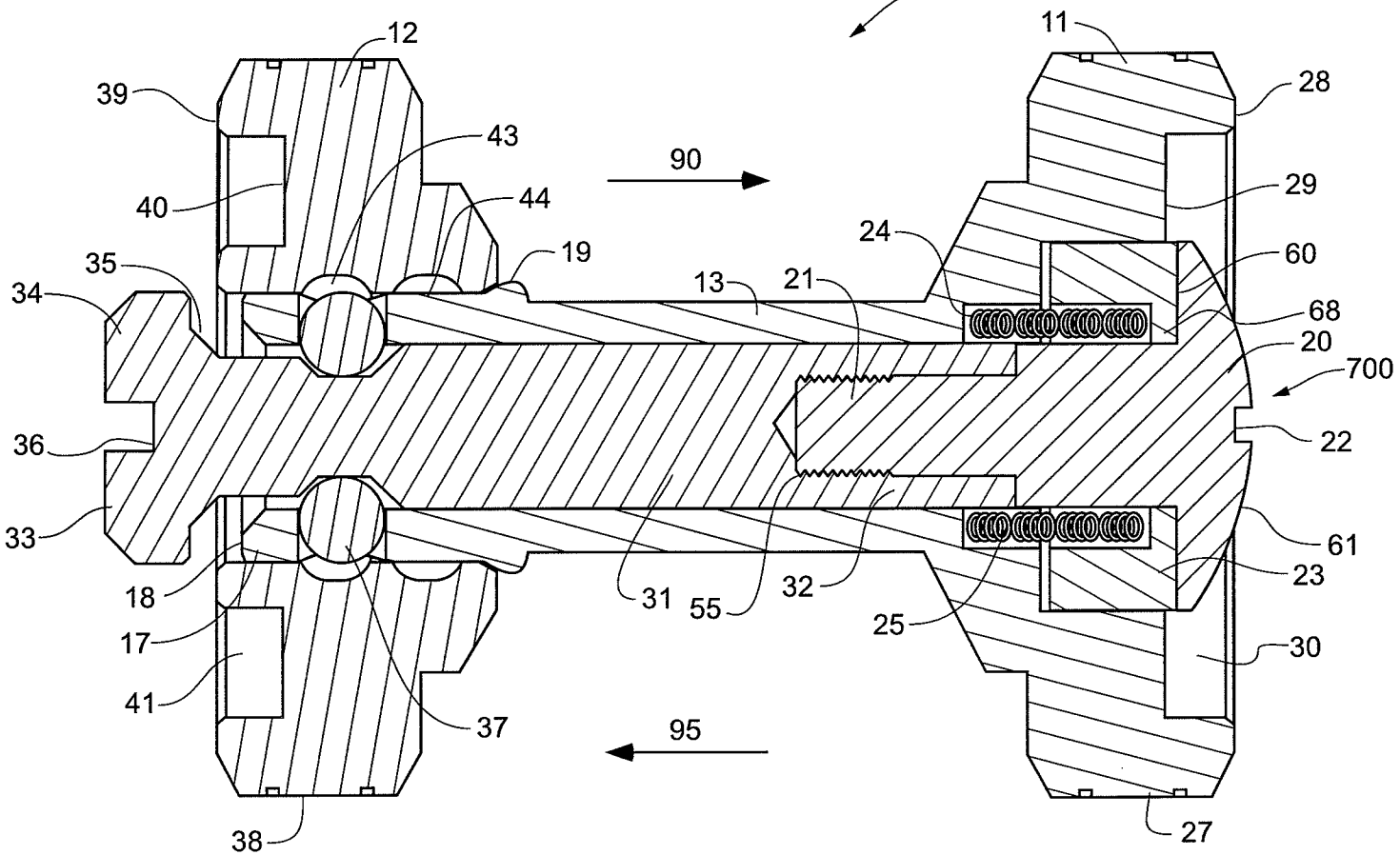
FIG. 2 illustrates a cross-sectional side view of a cufflink in accordance with the first embodiment, wherein the first and second heads are shown in a releasable configuration in which a shaft projecting from the first head is received by the second head but is not locked to the second head.
Figure 3:
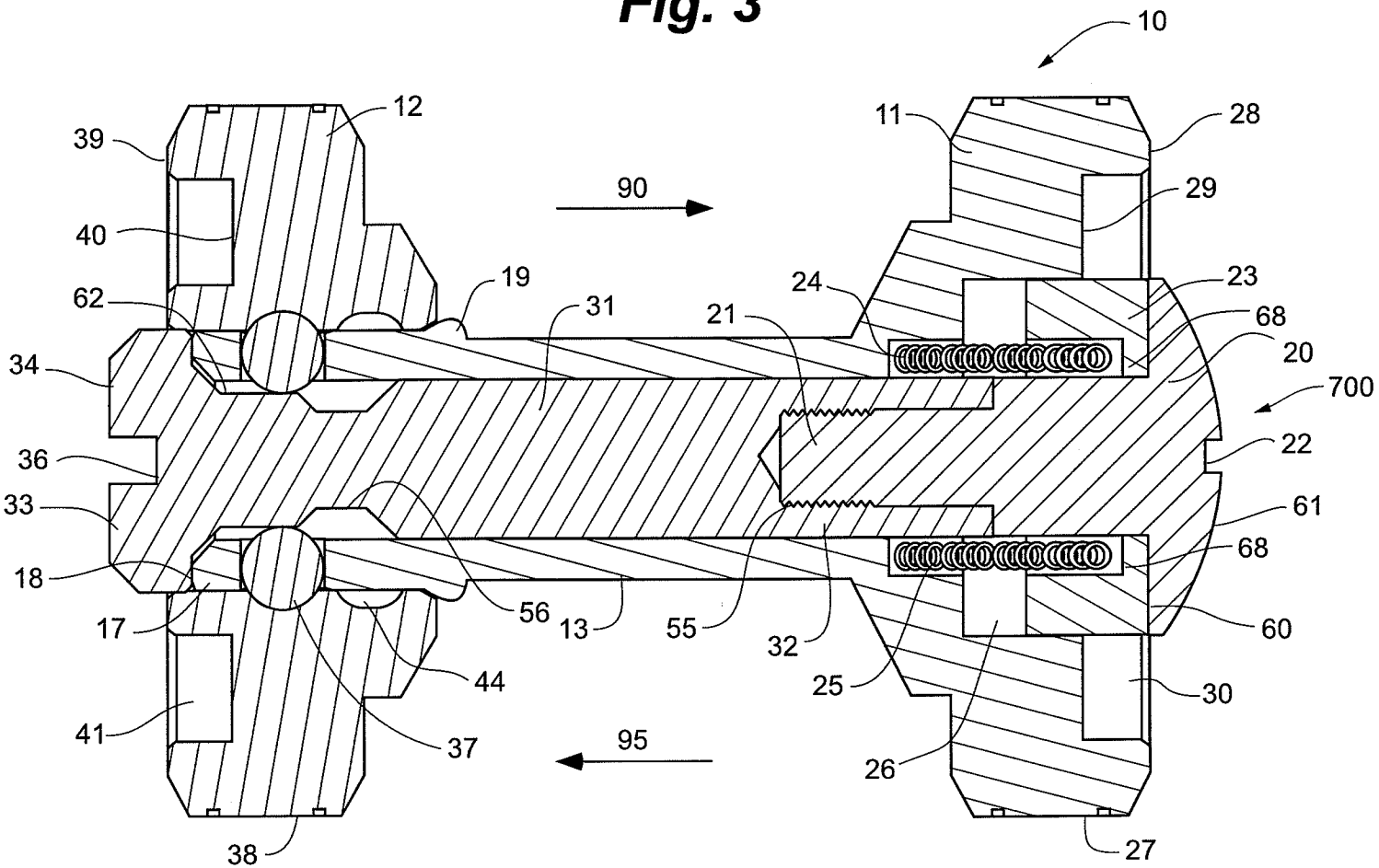
FIG. 3 illustrates a cross-sectional side view of a cufflink in accordance with the first embodiment, wherein the first and second heads are in a locked configuration such that a shaft projecting from the first head is locked to the second head.
Figure 4:
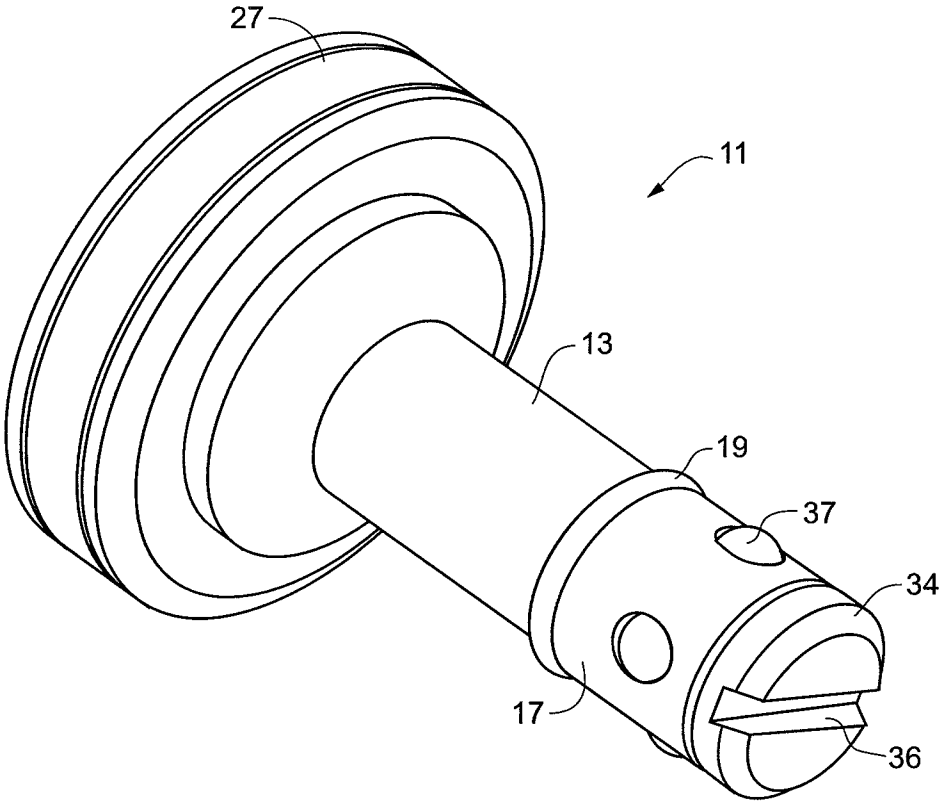
FIG. 4 illustrates a perspective view of a first head of a cufflink in accordance with the first embodiment.

FIGS. 1-5 illustrate a cufflink 10 in accordance with a first embodiment. The cufflink 10 includes a first head 11 and a second head 12. These heads are opposed to one another (i.e., they are at opposite ends of the cufflink). The first 11 and second 12 heads can be placed in a separated (or "detached") configuration, as shown in FIG. 1, or in a conjoined locked configuration, as shown in FIG. 3. In the embodiment illustrated, the first 11 and second 12 heads can be locked selectively in either a first locked position or a second locked position. Moreover, the cufflink can optionally be configured so as to have three or more locked positions. More will be said later of the optional adjustability feature.

Figure 15A:
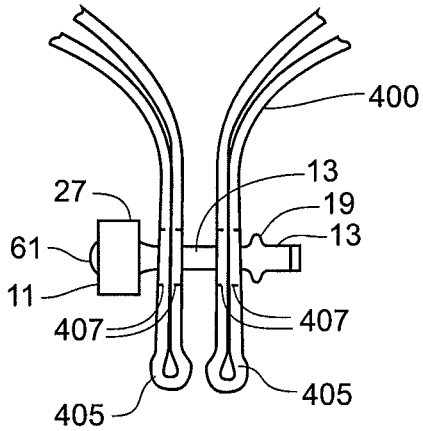
FIG. 15A is a partially broken-away side view of a shirt cuff on which a portion of a cufflink is mounted in accordance with certain embodiments of the invention.

In the embodiment of FIGS. 1-5, a shaft 13 projects from the first head 11 of the cufflink. In some cases, the first head 11 and the shaft 13 are defined by a single integral body, although this is not strictly required. The shaft 13 extends from the first head 11 to a distal end region 17. The illustrated shaft 13 has an optional retention structure 19 configured to temporarily retain the first head 11 and shaft 13 on a shirt cuff while the wearer manipulates the second head 12 so as to lock it to the shaft. Referring to FIG. 15A, it can be appreciated that the retention structure 19 is configured to temporarily retain the shaft 13 and first head 11 on the cuff 400 such that two cuff end regions 405 defining four aligned cuff holes 407 (or, in other cases, defining two aligned cuff holes) are retained between the retention structure 19 and the first head 11 (this typically involves four plies or layers of the shirt being retained between the retention structure and the first head). The user inserts the shaft 13 through the aligned cuff holes 407 and thereafter locks the second head 12 to the shaft (see FIG. 15B).

In the embodiment of FIGS. 1-5, the retention structure 19 comprises a raised retention ring projecting radially outward from the shaft 13. The retention structure 19 is located between the shaft's distal end region 17 and the first head 11. The illustrated retention ring 19 is closer to the shaft's distal end region 17 than to the first head 11. Preferably, the retention ring 19 is an integral projection of the shaft 13. Alternatively, a discrete ring can be joined to the shaft at the desired position. The illustrated retention ring extends entirely about a perimeter (e.g., a circumference) of the shaft. However, this is not required. For example, the retention structure can alternatively comprise a plurality of ridges spaced apart about the shaft's perimeter. Other raised catch structures can also be used as the retention structure.

When provided, the retention structure 19 provides two benefits. First, as noted above, it can hold the shaft and first head on a shirt while the wearer manipulates the second head so as to lock it to the shaft. Second, it can facilitate secure locking of the second head on the shaft. Referring to FIG. 3, the retention ring bears against the second head when the shaft is locked in the illustrated position. Here, a portion of the second head is wedged between the retention ring and locking balls carried by the shaft. As a result, the shaft and second head are secured together in a particularly stable manner (due to the engagement of the balls 37 and the ball-receipt groove 43 as well as the engagement of the retention ring 19 and a wall of the second head 12).

In the embodiment of FIGS. 1-5, the cufflink has a ball lock mechanism in combination with a long shaft having a retention structure 19. Here, the ball lock mechanism is configured to releasably lock the distal end region 17 of the shaft 13 within the central recess (or "internal opening") 42 defined by the second head 12. The illustrated ball lock mechanism comprises a plurality of balls 37 carried by the shaft 13, although other embodiments provide the balls on the second head while at least one corresponding ball-receipt groove is formed on the shaft. The illustrated retention structure 19 comprises a raised protrusion (extending from the shaft) located closer to the first head 11 than are the balls 37 of the ball lock mechanism.

In FIGS. 1-5, the retention structure 19 is a retention ring having first and second surface regions. The first surface region faces generally toward the first head (and is defined by the side of the retention ring that is adjacent to the first head), and the second surface region faces generally toward the distal end region of the shaft (and is defined by the side of the retention ring that is adjacent to the shaft's distal end region). The first surface region is oriented at a steeper angle (measured upwardly from the surface of the shaft) than is the second surface region. The second surface region is thus configured to facilitate ready sliding of two cuff end regions (in direction 90) onto the shaft and past the retention ring, whereas the first surface region is configured to provide resistance to the two cuff end regions sliding (in direction 95) off the shaft past the retention ring.

As noted above, the retention structure 19 is optional. Thus, the cufflink of FIGS. 1-5 can be provided without the illustrated retention ring, if so desired.

The illustrated cufflink 10 includes an actuator 700 comprising a plunger 31. The plunger 31 has a proximal end region 32 and a distal end region 33. The proximal end region 32 of the illustrated plunger includes an interiorly threaded opening 55. The actuator 700 comprises a manually operable control 20 that is accessible for operating the actuator. Here, the actuator control 20 comprises a push button that can be pressed to move the actuator to an unlocked position. The illustrated actuator control 20 is a fastener having both a head (which serves as the push button) and an exteriorly threaded end region 21, which is threadingly received in the opening 55 of the plunger 31. Thus, the fastener serving as the actuator control 20 can be screwed into and unscrewed from the threaded opening 55 in the plunger. If desired, this arrangement can be reversed so that the plunger has the exteriorly threaded screw portion while the push button has the interiorly threaded opening. Other means for joining the plunger to a push button can also be used.

The illustrated actuator 700 comprises a subassembly that also includes an end cap 23 carried against the head of the fastener that serves as the actuator control 20. Here, the head defines a seat 60 against which the end cap 23 is carried. The end cap 23 can be permanently fixed to the seat 60 or it can be free floating between the seat 60, the spring 25, and the first head 11. Moreover, the end cap and the fastener can be a single integral body, if so desired.

The cufflink's first head 11 defines a first seat 24 for a biasing mechanism 25. In the illustrated embodiment, the biasing mechanism 25 is a spring, and the seat 24 is a spring seat. The end cap 23 defines a second seat 68 for the biasing mechanism 25. The illustrated spring 25 free floats between the first head's spring seat 24 and the end cap's spring seat 68.

During assembly, the proximal end of the plunger is inserted into the opening at the distal end of the shaft, and the plunger is pushed inside the shaft. The spring 25 is placed in the first head's spring seat 24. In cases where the end cap 23 is free floating, this cap is placed over the spring. The end region 21 of the fastener 20 is screwed into the threaded opening 55 of the plunger 31 until shoulder SR of the fastener abuts shoulder SH of the plunger (See FIG. 1).

The fastener 20 has an exposed surface (or "face") 61 that can include an engraving or stylized recess 22 or other type of design (e.g., inlays, laser markings, emblems, indicia, etc.). The fastener 20 can also be coated with, or fabricated from, many different materials. In some cases, the fastener 20 comprises (e.g., is formed of) anodized aluminum or stainless steel. In the illustrated embodiment, the distal end 21 of the fastener 20 defines a screw, and the exposed face 61 of the fastener has an engraving or stylized recess 22 defining a recessed logo configured to receive a screwdriver tip (which may be a standard tip or a special tip that matches the shape of the recessed logo). Here, the plunger and the push button are fastened together removably, although this is not strictly required.

Thus, the illustrated actuator 700 comprises a push button (defined here by a fastener 20) that is moveable (e.g., axially) in a backward direction 90 and a forward direction 95. The plunger 31 is connected to the push button and is also moveable in the backward direction 90 and the forward direction 95 (i.e., the plunger and the push button move conjointly).

The plunger 31 has a distal end 33 adjacent to which a shoulder stop 34 is provided. The shoulder stop 34 limits (prevents) movement of the plunger 31 in the backward direction 90 when the shoulder stop 34 is engaged with a stop surface 18 located at (e.g., on or defined by) the distal end region of the shaft 13. In the illustrated embodiment, the shoulder stop 34 is defined by an enlarged head at the plunger's distal end 33. The enlarged head 34 bears against the distal end of the shaft 13 when movement of the plunger 31 in the backward direction 90 is arrested.

Prior to the illustrated plunger's shoulder stop 34 engaging the shaft's stop surface 18, an optional chamfer adjacent the plunger's distal end 33 is designed to mate with a corresponding internal chamfer on the shaft 13. This provides an advantageous self-alignment feature. While this feature is advantageous, it is not required.

The biasing mechanism 25 biases the actuator 700 (which in the illustrated embodiment includes both the plunger and the push button) in the backward direction 90. In the illustrated design, the biasing mechanism 25 pushes the end cap 23, which in turn pushes the head of the fastener 20, in the backward direction 90. Since the fastener 20 is attached to the plunger 31, the plunger also moves in the backward direction 90 until the plunger's shoulder stop 34 engages a stop surface 18 of the shaft's distal end region 17 and thereby prevents further movement of the plunger 31 in the backward direction 90. When the plunger 31 is in this position, as shown in FIG. 3, it is in a locked position. Due to the biasing mechanism 25, this locked position is the plunger's default position.

An operator can move the plunger 31 from its default locked position to an unlocked position, as shown in FIGS. 1 and 2, by pushing the actuator control 20 (which in the illustrated embodiment is a push button defined by the head of a fastener). This causes the plunger 31 to move in the forward direction 95, thereby causing the plunger's shoulder stop 34 to move away from the shaft's stop surface 18 (such that a gap 35 results between the shoulder stop and the stop surface). The operator can subsequently allow the plunger 31 to move back from its unlocked position to its default locked position by simply ceasing to push the push button. When this is done, the biasing mechanism 25 moves the actuator 700 back to its locked position.

In the embodiment of FIGS. 1-5, the cufflink's first head 11 comprises a raised structure 28 configured to protect the actuator 700 from inadvertent actuation. The first head 11 also includes a recessed structure 29 located radially inward of the raised structure 28. The recessed structure 29 provides a finger clearance space 30 between the raised structure 28 and the push button. The finger clearance space 30 allows a person to use a finger or thumb to depress the push button. In certain embodiments, the raised structure 28 is a raised ring and the recessed structure 29 is a recessed ring. In the embodiments illustrated, the raised ring surrounds (e.g., encircles) the recessed ring, and the recessed ring surrounds (e.g., encircles) the push button. The illustrated raised ring is at the outer perimeter of the of the cufflink head, although this is not required.

The cufflink 10 includes a second head 12 opposite the first head 11. The first 11 and second 12 heads are configured to be detached from one another as shown in FIG. 1, or locked releasably to one another, as shown in FIG. 3. In some cases, the second head 12 is a single integral body. In the embodiment illustrated, the second head 12 has a generally annular configuration defining an internal opening 42 in which the distal end region 17 of the shaft 13 can be received. The distal end region 17 of the shaft 13 preferably is equipped with a ball-lock mechanism configured to facilitate locking the shaft 13 releasably to the second head 12. The distal end region 17 of the shaft 13 can comprise (e.g., define or be part of) a ball retainer that retains a plurality of balls 37, optionally four balls. In the illustrated embodiment, the ball retainer is at the shaft's distal end region 17. The plunger 31 defines a ball-receipt groove 56 configured to receive the balls 37 when the cufflink is in an unlocked configuration. The plunger also has a lock surface 62 located between the ball-receipt groove 56 and the plunger's distal end region 33.

In the illustrated embodiment, the opening 42 of the second head 12 has an interior wall defining at least one ball-receipt groove configured to receive the balls 37. The illustrated cufflink 10 is an adjustable cufflink, so the second head 12 defines two ball-receipt grooves (a first ball-receipt groove 43 and a second ball-receipt groove 44). These two ball-receipt grooves allow the cufflink 10 to be locked in either of two configurations. When the balls 37 are locked in the first ball-receipt groove 43, as shown in FIG. 3, the cufflink is locked in a first locked configuration. When the balls 37 are locked in the second ball-receipt groove 44, the cufflink is locked in a second locked configuration.

In the first locked configuration, the first 11 and second 12 heads are closer together than when in the second locked configuration. Thus, when the cufflink is mounted on a cuff and is in the second locked configuration, there is more clearance space within the linked cuff than when the cufflink is in the first locked configuration. In certain embodiments, the first 11 and second 12 heads are at least 0.025 inch further apart (or at least 0.05 inch, at least 0.075 inch, or at least 0.08 inch, such as about 0.083 inch) when the cufflink is locked in its second configuration than when locked in its first configuration. The illustrated cufflink is non-expandable in that, when it is in the first locked configuration, its two heads are positively locked a first distance apart, and when it is in the second locked configuration, the two heads are positively locked a second distance apart. Moreover, the cufflink can optionally have three or more such locked configurations. This can be accomplished, for example, by adding at least one more ball-receipt groove to the illustrated second head 12. In some cases, this may involve adding length to the second head to make room for the additional ball-receipt groove(s).

When it is desired to lock the first head 11 to the second head 12, a person positions the shaft 13 in the internal opening 42 of the second head 12. As part of doing this, the push button of the actuator 700 is pressed so as to move the plunger 31 in the forward direction 95 to the unlocked position. This is best appreciated with reference to FIG. 2. The shaft 13 is moved into the second head's internal opening 42 such that the balls 37 are aligned with either the first ball-receipt groove 43 or the second ball-receipt groove 44, depending on whether the user wants the cufflink in the first or second locked configuration. In FIG. 2, the balls are aligned with the first ball-receipt groove 43, but they are not yet locked in that groove 43. At this point, the user has only to release the push button, such that the biasing mechanism 25 moves the actuator 700 to its locked position, thereby causing the balls to move radially outward into locked engagement with the groove 43 (at which point the balls 37 are retained in this position by virtue of their engagement with the plunger's lock surface 62). The resulting locked configuration is shown in FIG. 3.

Thus, to lock the balls 37 in one of the grooves 43, 44, the user releases the pushing force on the actuator, which allows the biasing mechanism 25 to bias the actuator 700 in the backward direction 90, thus moving the plunger 31 to its default locked position (shown in FIG. 3). As the plunger 31 moves in the backward direction 90, the plunger's ball-receipt groove 56 also moves in the backward direction 90. This causes the balls 37 to move along the plunger 31 from its ball-receipt groove 56 toward and up onto its lock surface 62. The lock surface 62 positions the balls 37 in their expanded configuration, thereby locking them in the desired groove. When the balls 37 are locked in a ball-receipt groove, the shaft 13 is positively locked to the second head 12.

To unlock the balls 37 from one of the grooves 43, 44, the user applies a pushing force to the push button, which causes the actuator 700 to move in the forward direction 95. As the actuator 700 moves in the forward direction 95, the plunger's ball-receipt groove 56 moves in the forward direction 95. This causes the balls 37 to move from the plunger's lock surface 62 toward and down into the plunger's ball-receipt groove 56. The recess of the ball-receipt groove 56 allows the balls 37 to fall into this groove, thereby unlocking the balls from either of grooves 43, 44. While continuing to apply the pushing force to the push button, the user can then either remove the first head 11 from the second head 12 or adjust the cufflink from its first locked configuration to its second locked configuration (or vice versa).

Figure 15B:
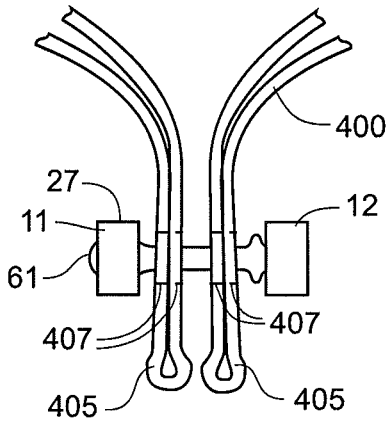
FIG. 15B is a partially broken-away side view of an adjustable cufflink mounted on a shirt cuff in accordance with certain embodiments of the invention.

Preferably, each head of the cufflink is too large to pass through a standard cuff hole. For example, the cufflink can be specifically designed for use on (or provided in combination with) a shirt cuff having cuff holes of a desired size. Each cuff hole has a length and the first 11 and second 12 heads can each have an outer dimension (optionally an outer diameter) larger than this length. In such cases, neither head can pass through the corresponding cuff holes. A cufflink with such large heads is attached to the corresponding cuff holes by first detaching the first head 11 from the second head 12, as shown in FIG. 1. The user then inserts the shaft 13 through the aligned cuff holes (typically four aligned cuff holes, but in some cases two) such that the cuff end regions defining the aligned cuff holes are retained between the retention ring 19 and the first head 11. Reference is made to FIG. 15A. The user then inserts the shaft distal end 17 into the internal opening 44 of the second head 12 and locks the shaft 13 to that head 12. The resulting locked assembly is shown in FIG. 15B. Thus, certain embodiments provide the cufflink in combination with (e.g., mounted on) a shirt cuff.

Figure 16A:
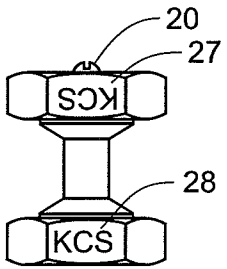
FIG. 16A is a side view of a cufflink in accordance with certain embodiments of the invention, wherein two halves of the cufflink are attached to each other.
Figure 16B:
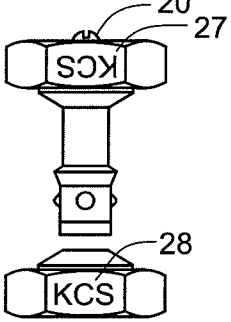
FIG. 16B is a side view of the cufflink of FIG. 16A, the two halves being shown in a separated state.
Figure 16C:
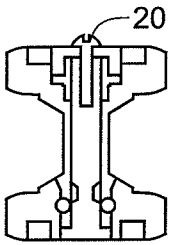
FIG. 16C is a cross-sectional side view of the cufflink of FIG. 16A.
Figure 16D:
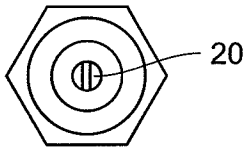
FIG. 16D is a front end view of the cufflink of FIG. 16A.
Figure 16E:
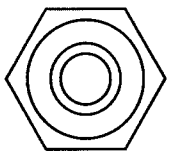
FIG. 16E is a back end view of the cufflink of FIG. 16A.

In the illustrated embodiments, the first head 11 has a side surface 27 defining a desired shape and the second head 12 has a side surface 38 defining a desired shape. In many cases, these side surfaces 27, 38 define the same shape. For example, in FIGS. 1-5, these side surfaces 27, 38 define a ring shape. Alternatively, these side surfaces 27, 38 can define another shape, such as a square shape, rectangular shape, triangular shape, hex shape, or another polygonal shape. These side surfaces 27, 38 can optionally be coated or provided with a desired surface finish. In some cases, these surfaces 27, 38 are defined by anodized aluminum or stainless steel. Additionally or alternatively, these surfaces 27, 38 can have engravings, inlays, laser markings, emblems, indicia, etc. FIGS. 16A and 16B, for example, show embodiments wherein initials are monogrammed into the side surfaces 27, 38 of the cufflink's heads 11, 12.

In some cases, the second head of the cufflink may be generally annular. This includes the shape of the second head shown in FIG. 4 as well as the shape of the second head shown in FIG. 16A. Many other head shapes can be used, of course.

In embodiments like that shown in FIGS. 1-5, the plunger 31 has a larger diameter on one side of its ball-receipt groove 56 than on the other side of that groove. As illustrated, the diameter of the plunger's lock surface 62 is smaller than the diameter of the plunger on the proximal side of the ball-receipt groove 56. This is not required. However, this relative dimensioning can be provided advantageously to prevent the plunger from falling out of the shaft 13 (after which the balls might fall off) in the event a person were to separate the fastener 20 from the plunger. The same relative dimensioning can optionally be provided in other embodiments, such as those shown in FIGS. 6-10, which are described below.

The cufflink shown in FIGS. 1-5 can be made in the following exemplary way. The female head 12, male head/protrusion 11, fastener 20, plunger 31, and end cap 23 are turned from bar stock on manual or CNC lathes. Any of these components could possibly be cold formed from coil steel, or at least partially requiring secondary machining as well as cast. Preferred materials used for the head components may be stainless steel, copper, and aluminum, although other materials such as carbon steel may be used. The plunger, end cap, and fastener are preferably manufactured of type 316 stainless steel, however they can be made of other materials, such as those referenced above. The parts can be electropolished after they are made to their finished form from one of the preceding methods; may be left in their raw state or finished in coatings such as anodizing, plating, vermeil, or physical vapor deposition among other finishes; and finally can be laser marked with serial number, brand, and personalized information. Springs can be an off-the-shelf stainless steel item purchased, e.g., from Century Spring, Los Angeles, Calif. The balls, which preferably formed of stainless steel (but can alternatively be formed of other materials, such as chrome steel), are an off the shelf item (which can be purchased from, e.g., Hoover Precision Products of Cumming, Ga.) and are staked into their corresponding receptacles using a press that deforms the metal at the outer circumference of the respective holes on the shaft of the head 11. This forms a subassembly and due to the larger diameter of the plunger above the balls, is permanently affixed. The aforementioned parts and subassembly are then assembled per the illustrations referenced and secured with a drop of thread locking adhesive such as Loctite.

Figure 6:
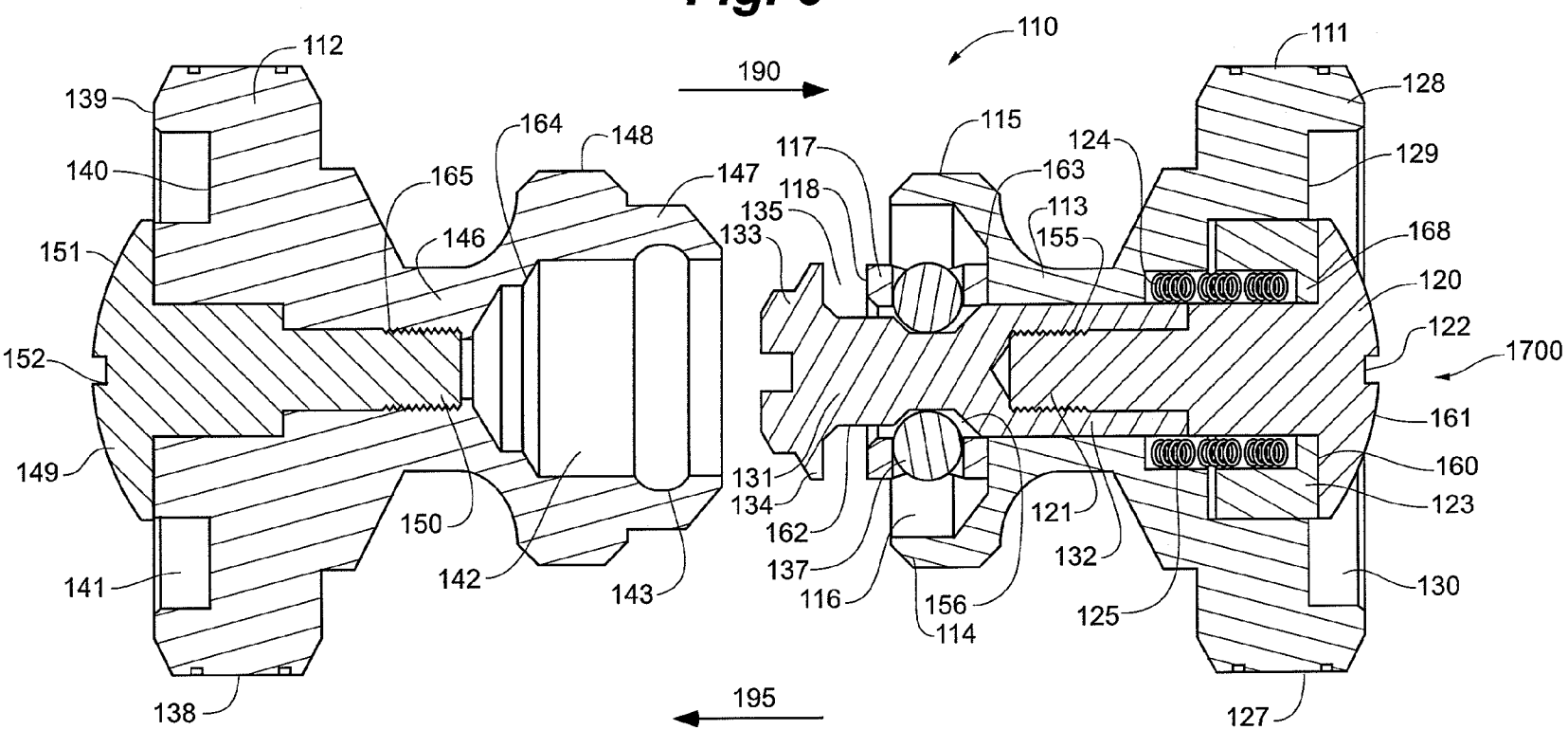
FIG. 6 illustrates a cross-sectional side view of a cufflink in accordance with a second embodiment, wherein the cufflink has first and second heads, these heads being shown in a separated configuration.
Figure 7:
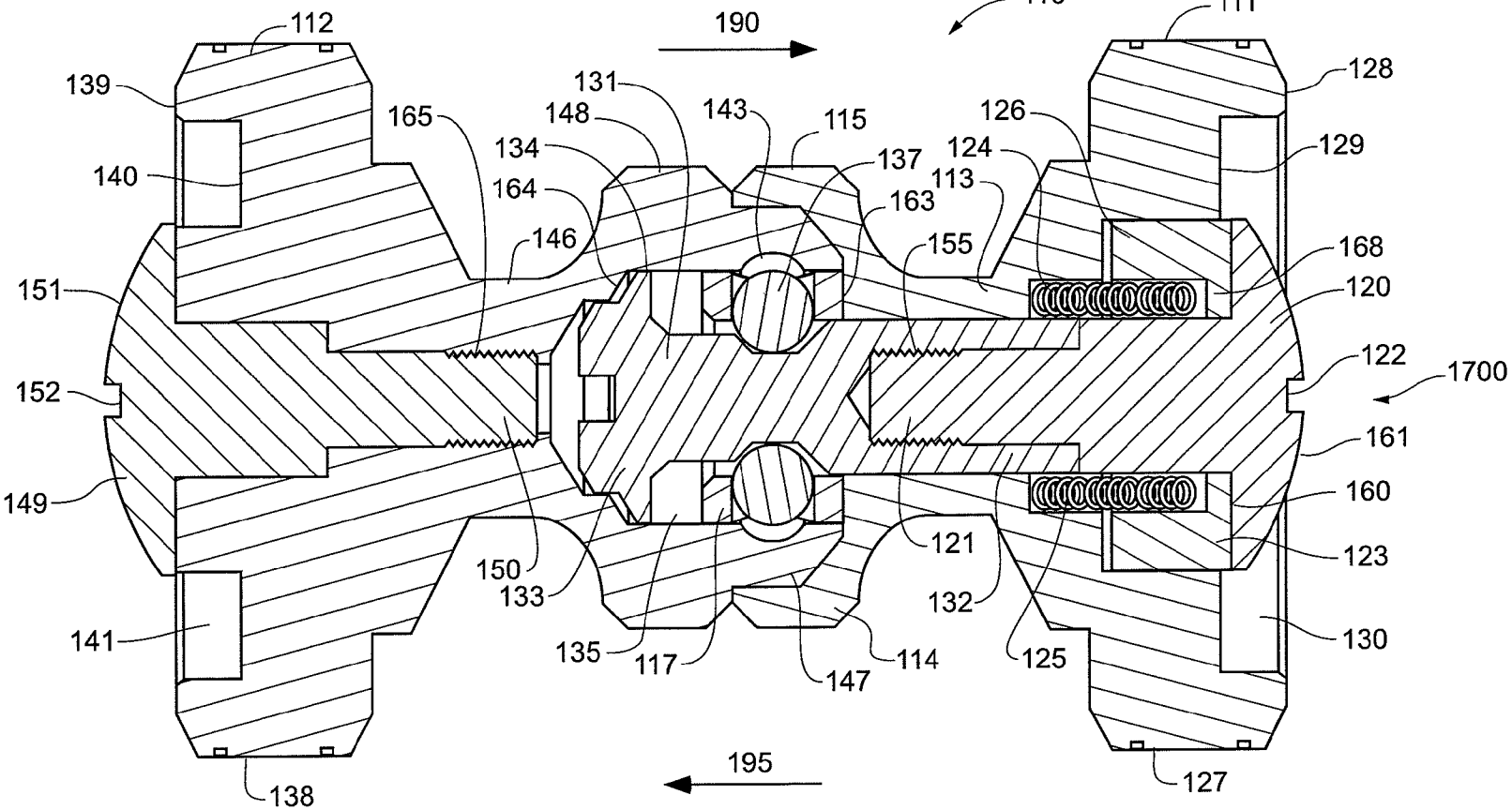
FIG. 7 illustrates a cross-sectional side view of a cufflink in accordance with the second embodiment, wherein the first and second heads are shown in a releasable configuration in which a neck portion projecting from the first head is mated with a neck portion projecting from the second head but where those neck regions are not locked to each other.
Figure 8:
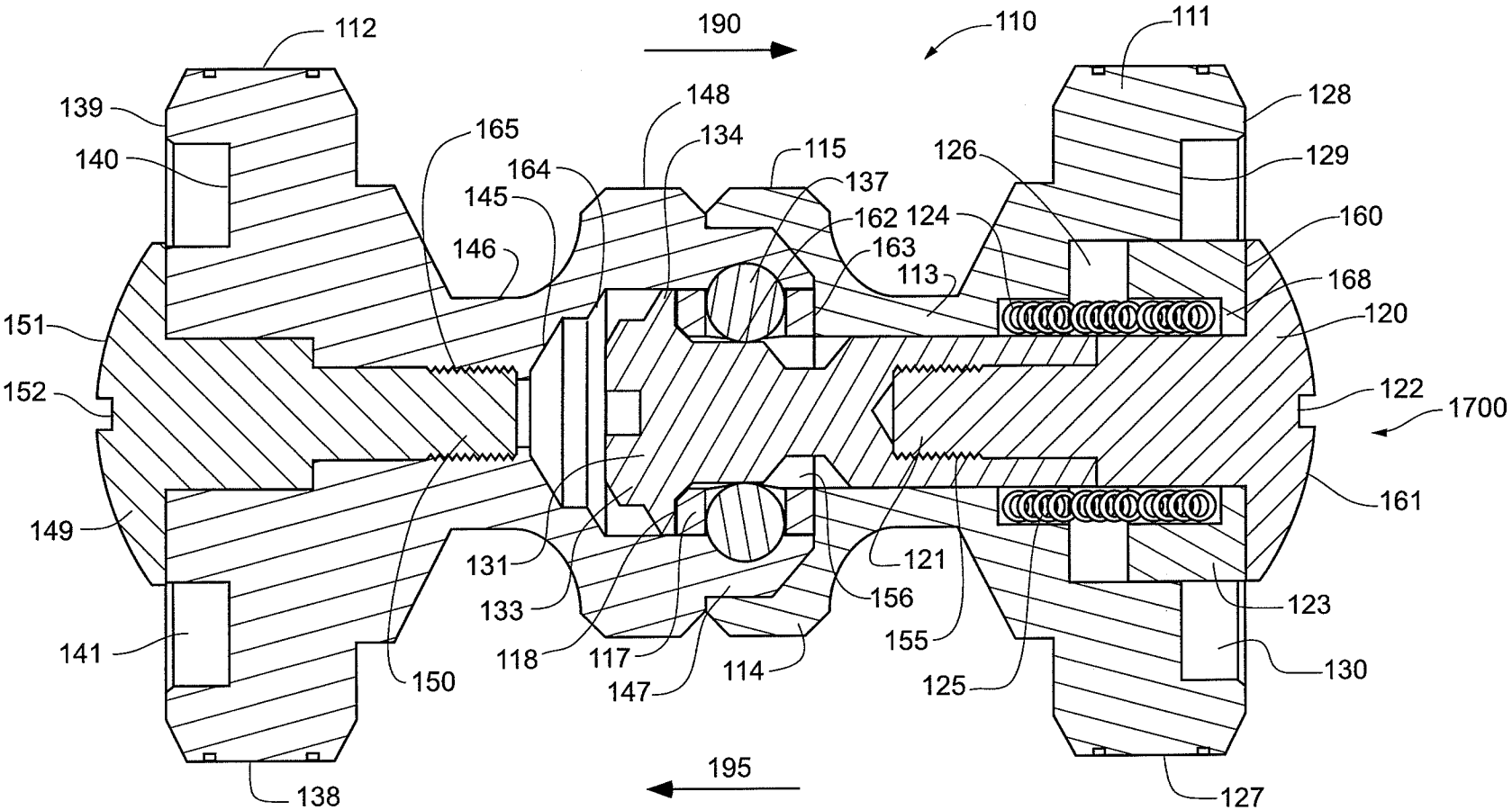
FIG. 8 illustrates a cross-sectional side view of a cufflink in accordance with the second embodiment, wherein the first and second heads are shown in a locked configuration in which the neck portions projecting respectively from the two heads are locked to each other.
Figure 9:
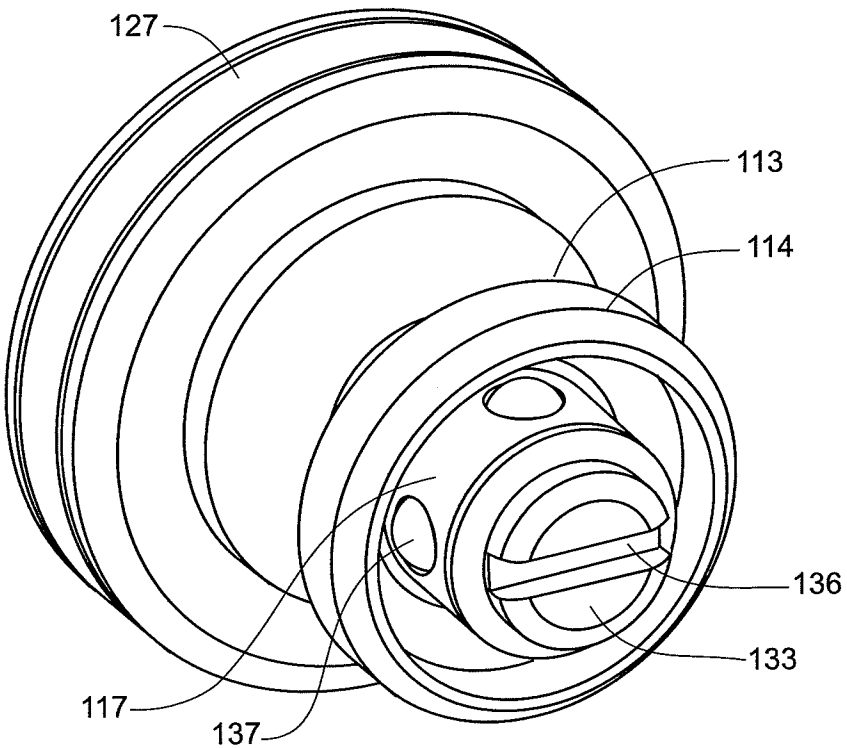
FIG. 9 illustrates a perspective view of a first head of a cufflink in accordance with the second embodiment.

FIGS. 6-10 illustrate a cufflink 110 in accordance with a second embodiment. Here again, the cufflink 110 includes a first head 111 and a second head 112. These two heads are opposed to each other (i.e., they are at opposite ends of the cufflink). The two heads 111, 112 can be placed in a separated (or "detached") configuration, as shown in FIG. 6, or in a conjoined locked configuration, as shown in FIG. 8. A first neck region 113 projects from the first head 111 to a mateable distal end region 114. In some embodiments, the first head 111, first neck region 113, and first distal end region 114 are all defined by a single integral body. However, this is not required.

The illustrated cufflink 110 includes an actuator 1700 comprising a plunger 131. The plunger 131 has a proximal end region 132 and a distal end region 133. The proximal end region 132 of the illustrated plunger 131 includes an interiorly threaded opening 155. The actuator 1700 comprises a manually operable control 120 that is accessible for operating the actuator. Here, the actuator control 120 comprises a push button that can be pressed to move the actuator to an unlocked position. The illustrated control 120 is a fastener having both a head (which serves as the push button) and an exteriorly threaded end region 121 that is threadingly received in the opening 155 of the plunger 131. As such, the fastener serving as the actuator control 120 can be screwed into and unscrewed from the threaded opening 155 in the plunger.

The illustrated actuator 1700 comprises a subassembly that also includes an end cap 123 carried against the head of the fastener that serves as the actuator control 120. Here, the head defines a seat 160 against which the end cap 123 is carried. The end cap 123 can be permanently fixed to the seat 160 or it can be free floating between the seat 160, the spring 125, and the first head 111. Moreover, if desired, the end cap and the fastener can be a single integral body.

The cufflink's first head 111 defines a first seat 124 for a biasing mechanism 125. In the illustrated embodiment, the biasing mechanism 125 is a spring, and the seat 124 is a spring seat. The end cap 123 defines a second seat 168 for the biasing mechanism 125. The illustrated spring 125 free floats between the first head's spring seat 124 and the end cap's spring seat 168.

The fastener 120 has an exposed surface (or "face") 161 that can include an engraving or stylized recess 122 or other type of design (e.g., inlays, laser markings, emblems, indicia, etc.). The fastener 120 can also be coated with, or fabricated from, many different materials. In some cases, the fastener 120 comprises (e.g., is formed of) anodized aluminum or stainless steel. In the illustrated embodiment, the distal end 121 of the fastener 120 defines a screw, and the exposed face 161 of the fastener 120 has an engraving or stylized recess 122 configured to receive a screwdriver head (which may be a standard tip or a special tip that matches the shape of the recessed logo).

As noted above, the illustrated actuator 1700 comprises a push button (defined here by a fastener 120) that is moveable (e.g., axially) in a backward direction 190 and a forward direction 195. The plunger 131 is connected to the push button and is also moveable in the backward direction 190 and the forward direction 195 (i.e., the plunger and the push button move conjointly).

The plunger 131 has a distal end 133 adjacent to which a shoulder stop 134 is provided. The shoulder stop 134 limits (prevents) the movement of the plunger 131 in the backward direction 190 when the shoulder stop 134 is engaged with a stop surface 118 defined by the cufflink's first segment (or "first half"). In the illustrated embodiment, the shoulder stop 134 is defined by an enlarged head at the plunger's distal end 133. The enlarged head 134 bears against a stop surface 118 defined by a ball retainer 117 (which is located at the first distal end region 114) when movement of the plunger 131 in the backward direction 190 is arrested.

The biasing mechanism 125 biases the actuator 1700 (which in the illustrated embodiment includes both the plunger and the push button) in the backward direction 190. In the illustrated design, the biasing mechanism 125 pushes the end cap 123, which in turn pushes the head of the fastener 120, in the backward direction 190. Since the fastener is attached to the plunger 131, the plunger also moves in the backward direction 190 until the plunger's shoulder stop 134 engages the stop surface 118 of the ball retainer 117 and thereby prevents further movement of the plunger 131 in the backward direction 190. When the plunger 131 is in this position, as shown in FIG. 8, it is in a locked position. Due to the biasing mechanism 125, this locked position is the plunger's default position.

An operator can move the plunger 131 from the default locked position to an unlocked position, as shown in FIGS. 6 and 7, by pushing the actuator control 120 (which in the illustrated embodiment is a push button defined by the head of a fastener). This causes the plunger 131 to move in the forward direction 195, thereby causing the plunger's shoulder stop to move away from the stop surface 118 of the ball retainer 117 (such that a gap 135 results between the shoulder stop and the stop surface). The operator can subsequently allow the plunger 131 to move back from its unlocked position to its default locked position by simply ceasing to push the push button. When this is done, the biasing mechanism 125 moves the actuator 1700 back to its locked position.

In the embodiment of FIGS. 6-10, the cufflink's first head 111 comprises a raised structure 128 configured to protect the actuator 1700 from inadvertent actuation. The first head 111 also includes a recessed structure 129 located radially inward of the raised structure 128. The recessed structure 129 provides a finger clearance space 130 between the raised structure 128 and the push button. The finger clearance space 130 allows a person to use a finger or thumb to depress the push button. In certain embodiments, the raised structure 128 is a raised ring and the recessed structure 129 is a recessed ring. In the embodiments illustrated, the raised ring surrounds (e.g., encircles) the recessed ring, and the recessed ring surrounds (e.g., encircles) the push button.

The cufflink 110 includes a second head 112 opposite the first head 111. A second neck 146 projects from the second head 112 to a mateable distal end region 147. In some embodiments, the second head 112, second neck region 146, and second distal end region 147 are defined by a single integral body. This, however, is not required.

The distal end region 114 projecting from the first neck 113 is configured to mate lockingly with the distal end region 147 projecting from the second neck 146. In the illustrated embodiment, the second distal end region 147 is configured as a male end region and the first distal end region 114 is configured as a female end region. Thus, the female distal end region 114 receives the male distal end region 147. This arrangement, however, can be reversed, if so desired.

Figure 10:
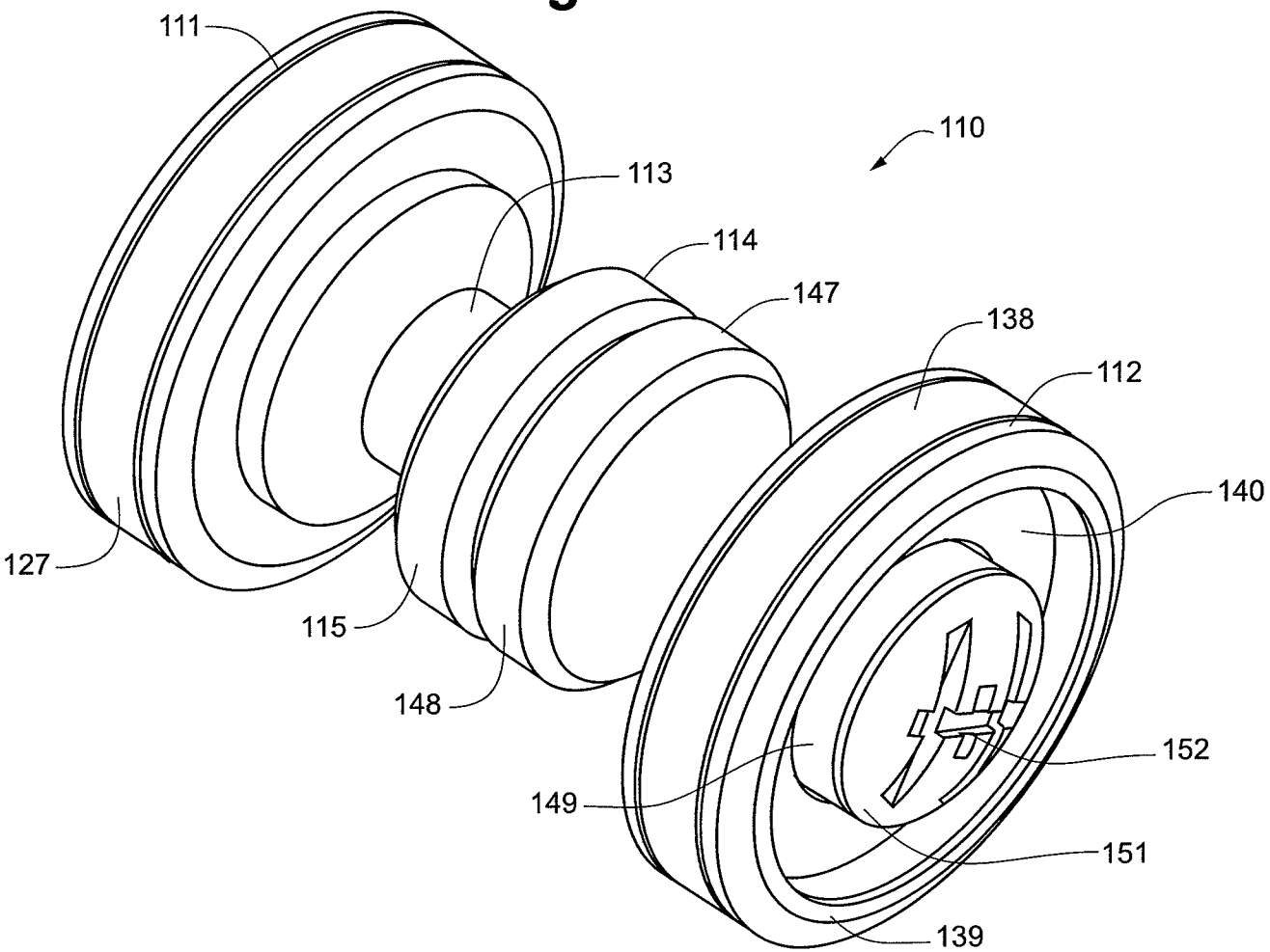
FIG. 10 illustrates a perspective view of a cufflink in accordance with the second embodiment, the first and second heads being shown in a locked configuration.
Figure 11:
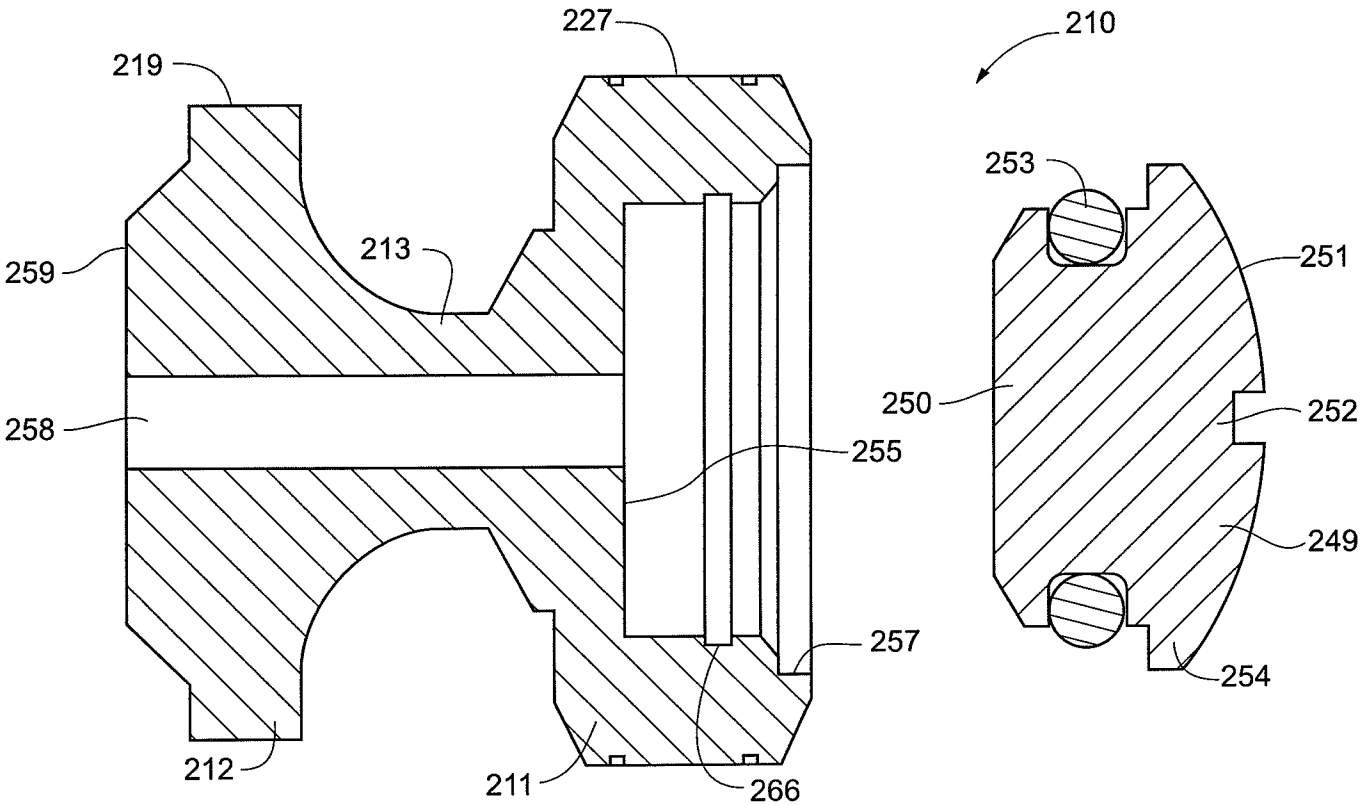
FIG. 11 illustrates a cross-sectional side view of a stud in accordance with a third embodiment, wherein the stud includes a removable decorative insert, the removable decorative insert and the body of the stud being shown in a separated configuration.
Figure 12:
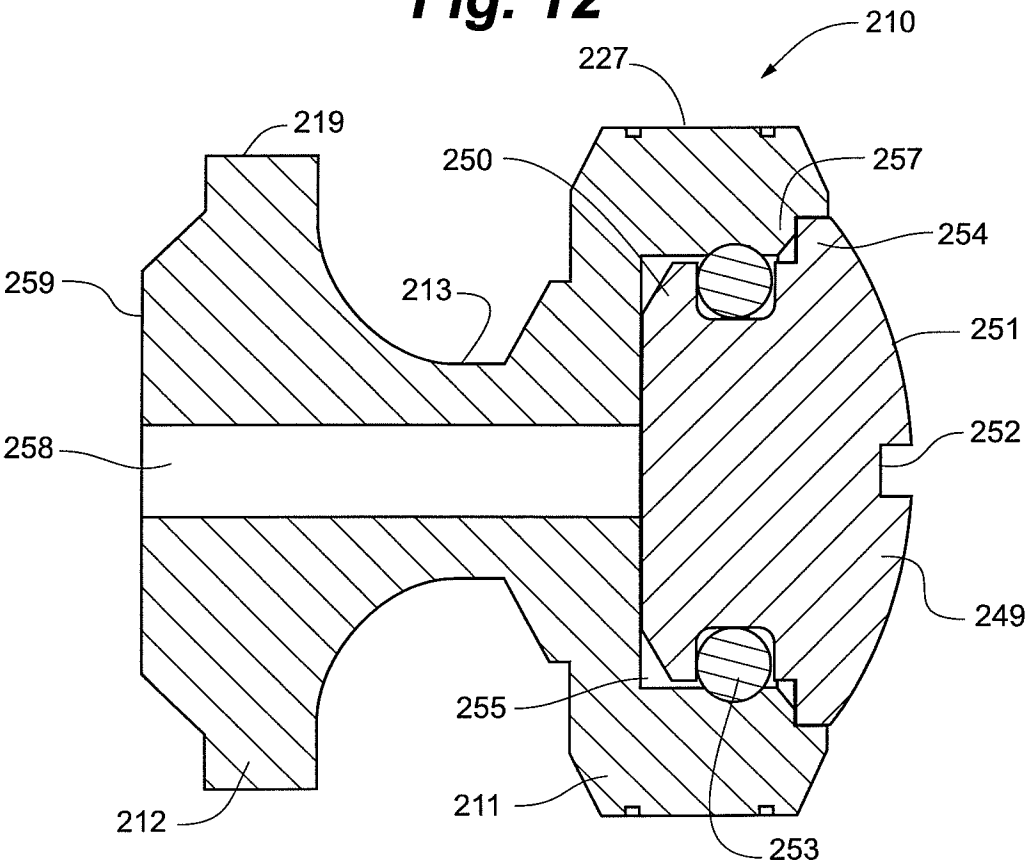
FIG. 12 illustrates a cross-sectional side view of a cufflink in accordance with the third embodiment, the removable decorative insert and the body of the stud being shown in a conjoined configuration.

The first distal end region 114 defines an exposed side surface 115. Likewise, the second distal end region 147 defines exposed side surface 148. In many cases, both of these outer surfaces 115, 148 define the same shape. For example, as shown in FIG. 10, the outer surfaces 115, 148 can be ring-shaped surfaces. Thus, when the distal end regions 114, 147 are locked together, the outer surfaces 115, 148 define two adjacent rings, as is best seen in FIG. 10. Alternatively, these surfaces 115, 148 can define other shapes, such as a square shape, rectangular shape, triangular shape, hex shape, or another polygonal shape. These side surfaces 115, 148 can optionally be coated or provided with a desired surface finish. In some cases, these surfaces 115, 148 are defined by anodized aluminum or stainless steel. Additionally or alternatively, these surfaces 115, 148 can have engravings, inlays, laser markings, emblems, indicia, etc.

The first distal end region 114 and the second distal end region 147 can each serve as retention structures. For example, the first distal end region 114 can serve as a retention structure to temporarily retain the first segment of the cufflink on a cuff (such that a single cuff end region is retained between the first distal end region 114 and the first head 111). Likewise, the second distal end region 147 can serve as a retention structure to temporarily retain the second segment of the cufflink on a cuff (such that a single cuff end region is retained between the second distal end region 147 and the second head 112). This allows the user to temporarily retain the two segments of the cufflink on respective cuff end regions until the two segments are locked together.

The illustrated cufflink 110 includes a ball-lock mechanism configured to releasably lock the first distal end region 114 to the second distal end region 147. In the illustrated embodiment, the ball-lock mechanism includes a ball retainer 117 that holds a plurality of balls 137, optionally four balls. In the illustrated embodiment, the ball retainer 117 is not integral to the body defining the first head 111, the neck region 113, and the first distal end region 114. Instead, the first distal end region 114 defines a mounting seat 163 against which the ball retainer 117 is mounted. Alternatively, the ball retainer 117 can be integral to the first distal end region 114. The ball retainer 117 has a stop surface 118 configured to engage a shoulder stop 134 of the plunger 131, as noted above.

The second distal end region 147 has a generally annular configuration and defines an internal opening 142 in which the distal end 133 of the plunger 131 and the ball retainer 117 are received when the two halves of the cufflink are locked together. The interior wall of the opening 142 defines a ball-receipt groove 143 that is engaged by the balls (i.e., into which the balls project) so as to lock the two cufflink segments together.

When it is desired to lock the first head 111 to the second head 112, a person moves the plunger 131 and ball retainer 117 into the internal opening 142 of the second distal end region 147. As part of doing this, the push button of the actuator 1700 is pressed so as to move the plunger 131 in the forward direction 195 to its unlocked position. This is best appreciated with reference to FIG. 7. The plunger 131 and ball retainer 117 are moved into the opening 142 of the second distal end region 147 such that the balls 137 are aligned with the ball-receipt groove 143. In FIG. 7, the balls 137 are aligned within the ball-receipt groove 143 but are not yet locked in that groove 143.

To lock the balls 137 within the groove 143, the user simply releases the pushing force on the push button, such that the biasing mechanism 125 moves the actuator 1700 in the backward direction 190 to its locked position thereby causing the balls 137 to move radially outward into locked engagement with the groove 143 (at which point the balls are retained in this position by virtue of their engagement with the plunger's lock surface 162). The resulting locked configuration is shown in FIG. 8.

Thus, to lock the balls 37 in the groove 143, the user releases the pushing force on the actuator, which allows the biasing mechanism 125 to bias the actuator 1700 in the backward direction 190, thus moving the plunger 131 to its default locked position (shown in FIG. 8). As the plunger 131 moves in the backward direction 190, the plunger's ball-receipt groove 156 also moves in the backward direction 190. This causes the balls 137 to move along the plunger 131 from its ball-receipt groove 156 toward and up onto the lock surface 162 of the plunger. The lock surface 162 positions the balls 137 in their expanded configuration, thereby locking them in the ball-receipt groove 143. When the balls 137 are locked in the ball-receipt groove 143, the two halves of the cufflink are locked together releasably.

To unlock the balls 137 from the groove 143, the user applies pushing force to the push button, which causes the actuator 1700 to move in the forward direction 195. As the actuator 1700 moves in the forward direction 195, the plunger's ball-receipt groove 156 moves in the forward direction 195. This causes the balls 137 to move along the plunger 131 from its lock surface 162 toward and down into its ball-receipt groove 156. The recess of the ball-receipt groove 156 allows the balls 137 to fall into this groove, thereby unlocking the balls 137 from groove 143. While continuing to apply the pushing force to the push button, the user can move the two halves of the cufflink apart.

Preferably, each head of the cufflink is too large to pass through a standard cuff hole. For example, the cufflink can be specifically designed for use on a shirt cuff having cuff holes of a known size. Each cuff hole has a length and the first 111 and second 112 heads can each have an outer dimension (optionally an outer diameter) larger than this length. In such cases, neither head can pass through the corresponding cuff holes. A cufflink with such large heads is attached to the corresponding cuff holes by first detaching the first head 111 from the second head 112, as shown in FIG. 6. The user then positions the first neck region 113 in one of two aligned cuff holes, positions the second neck region 146 in the other of the two aligned cuff holes, and then locks the two cufflink halves together.

In the illustrated embodiments, the first head 111 has a side surface 127 defining a desired shape, and the second head 112 has a side surface 138 defining a desired shape. In many cases, these side surfaces 127, 138 define the same shape. For example, in FIGS. 6-10, these side surfaces 127, 138 define a ring shape. Alternatively, these surfaces 127, 138 can define another shape, such as a square shape, rectangular shape, triangular shape, hex shape, or another polygonal shape. These side surfaces 127, 138 can optionally be coated or provided with a desired surface finish. In some cases, these surfaces 127, 138 are defined by anodized aluminum or stainless steel. Additionally or alternatively, these surfaces 127, 138 can have engravings, inlays, laser markings, emblems, indicia, etc.

The cufflink shown in FIGS. 6-10 can be made in the following exemplary way. Each head 111, 112/protrusion, the fastener 120, plunger 131, and end cap 123 are turned from bar stock on manual or CNC lathes. Any of these components could possibly be cold formed from coil steel, or at least partially requiring secondary machining as well as cast. Preferred materials used for the head components may be stainless steel, copper, and aluminum, although other materials such as carbon steel may be used. The plunger, end cap, and fastener are preferably manufactured of type 316 stainless steel, however they can be made of other materials, such as those referenced above. The parts can be electropolished after they are made to their finished form from one of the preceding methods; may be left in their raw state or finished in coatings such as anodizing, plating, vermeil, or physical vapor deposition among other finishes; and finally can be laser marked with serial number, brand, and personalized information. Springs can be an off-the-shelf stainless steel item purchased, e.g., from Century Spring, Los Angeles, Calif. The balls, which preferably formed of stainless steel (but can alternatively be formed of other materials, such as chrome steel), are an off the shelf item (which can be purchased from, e.g., Hoover Precision Products of Cumming, Ga.) and are staked into their corresponding receptacles using a press that deforms the metal at the outer circumference of the respective holes on the ball retainer 117. This forms a subassembly and due to the larger diameter of the plunger above the balls, is permanently affixed. The aforementioned parts and subassembly are then assembled per the illustrations referenced and secured with a drop of thread locking adhesive such as Loctite.

Combination Embodiments

In the embodiment shown in FIGS. 1-5, the shaft or neck 13 of the cufflink 10 has a retention ring 19, as already explained. The retention ring, however, can be omitted if so desired. Whether or not such a retention structure is provided, the cufflink can have one or more of the following features in different embodiments: 1) a plunger having the noted shoulder stop (the "assembly feature"), 2) a releasable locking mechanism adapted to lock the cufflink in two different configurations (the "adjustability feature"), and 3) the noted actuator shielding and finger access feature.

In one group of embodiments, the cufflink of FIGS. 1-5 has the assembly feature but the retention ring 19 is omitted. Further, the second head 12 of the cufflink in such embodiments can optionally have only one ball-receipt groove (such that these embodiments do not have the adjustability feature). Still further, the raised ring 28 encompassing the push button can be omitted in these embodiments, although this will commonly be less preferred.

In another group of embodiments, the cufflink of FIGS. 1-5 has the illustrated retention ring 19 but the raised ring 28 encompassing the push button is omitted. If desired, the second head 12 of the cufflink in these embodiments can optionally have only one ball-receipt groove (such that these embodiments do not have the adjustability feature). Alternatively, it can have three or more ball-receipt grooves.

In still another group of embodiments, the cufflink of FIGS. 1-5 has the noted actuator shielding and finger access feature but the illustrated retention ring 19 is omitted. The second head 12 of the cufflink in such embodiments can optionally have only one ball-receipt groove (such that these embodiments do not have the adjustability feature).

In a further group of embodiments, the cufflink of FIGS. 1-5 has the noted adjustability feature but the retention ring 19 is omitted. Further, the raised ring 28 encompassing the push button can be omitted in these embodiments, although this will commonly be less preferred.

In the embodiment shown in FIGS. 6-10, the raised ring 128 encompassing the push button. This raised ring 28, however, can be omitted if so desired.

For embodiments in which a cufflink is provided with a ball lock mechanism, the mechanism preferably includes three or more balls. This can provide a particularly stable lock.

Further, when the cufflink defines one or more ball-receipt grooves (optionally two or more), the wall defining each such groove can optionally be defined by a machined component, rather than a stamped component. This can provide a receptacle surface that is not prone to bending. In certain embodiments, the wall defining the ball-receipt groove(s) has a thickness of at least 0.01 inch, at least 0.02 inch, at least 0.025 inch, or at least 0.27 inch. The wall thickness here is measured from the center point of the radius of the ball-receipt groove to the adjacent exterior side surface of the cufflink (e.g., measured on a radial axis perpendicular to the cufflink's axis). In certain embodiments, this wall thickness is about 0.04 inch. Optionally, the thinnest wall thickness measured at any point on any ball-receipt groove is greater than one or more of the noted minimums. Embodiments of this nature are advantageous in that deformation of the receipt groove(s) can be eliminated or reduced.

Removable Insert Embodiments

FIGS. 11-14 illustrate a stud 210 in accordance with a third embodiment. The stud 210 includes a first head 211, second head 212, and central neck region 213. The two heads are at opposite sides of the stud and the neck extends between them (i.e., the neck connects the two heads). Here, the heads are enlarged and the neck is relatively narrow (e.g., has a relatively small diameter, as compared to the heads). In some cases, the first head 211, second head 212, and neck region 213 are defined by a single integral body. Alternatively, the stud can comprise two halves joined together to form the same general configuration as that shown. In still other embodiments, the stud can comprise three or more bodies joined together so as to define the two heads and the neck. Many variants of this nature will be apparent given the present teaching as a guide.

The first head 211 has (e.g., defines) a pocket 255 configured to receive a removable decorative insert 249. The illustrated pocket 255 has a larger diameter than the stud's neck (i.e., the exterior diameter of the neck is smaller than the diameter of the pocket). Depending on the desired size of the insert, however, this may or may not be the case. The illustrated pocket 255 has a round configuration. However, the pocket can alternatively have a polygonal or irregular configuration to accommodate an insert of corresponding shape.

The removable decorative insert 249 has an exposed surface or face 251. In the embodiment of FIGS. 11-14, this face 251 defines an outwardly round (e.g., convex) exterior surface. However, this is not required. For example, this face 251 can alternatively be planar.

Figure 13:
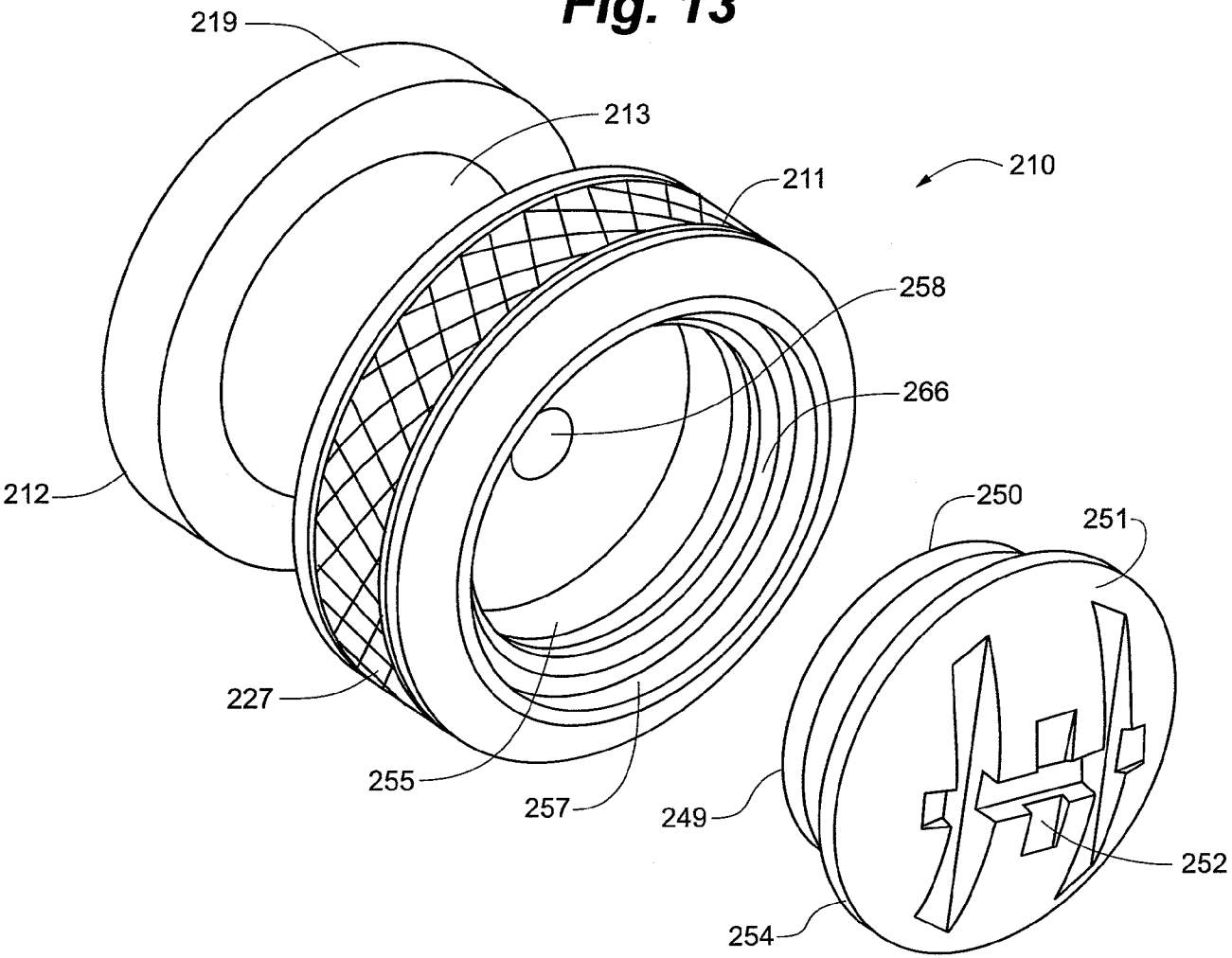
FIG. 13 illustrates a perspective view of a stud in accordance with the third embodiment, the removable decorative insert and the body of the stud being shown in a separated configuration.

The decorative face 251 of the insert 249 and the face 259 of the second head 212 are generally opposed. If desired, one or both faces 251, 259 can be coated or otherwise fabricated so as to have a variety of decorative features, such as a particular color, logo, etc. In some cases, one or both faces 251, 259 are defined by anodized aluminum or stainless steel. Additionally or alternatively, one or both faces 251, 259 can have engravings, inlays, laser markings, emblems, indicia, or any other desirable design 252. Referring to FIG. 13, it can be seen that the face 251 of the illustrated insert 249 has therein formed a recessed logo. This, however, is by no means required.

The illustrated insert 249 has a base 250 that is mounted against an internal wall defining the bottom of the pocket 255. This insert 249 also includes an optional shoulder 254 that is mounted against an optional shoulder seat 257 of the first head 211. An O-ring or another resilient retention member is provided between an exterior sidewall of the insert and an interior sidewall bounding the pocket. In the illustrated embodiment, an O-ring 253 is mounted on the insert 249. Here, the insert defines a channel in which the O-ring is mounted (see FIG. 12). The O-ring 253 is configured to engage an O-ring receipt groove 266 (see FIGS. 11 and 13) that is open to the pocket 255. To mount the insert 249 in the pocket 255, a person simply pushes the insert into the pocket until the O-ring 253 expands into the O-ring receipt groove 266. The O-ring 253 and O-ring receipt groove 266 together secure the insert 249 removably within the pocket 255. Once the insert 249 is mounted on the stud 210 in this manner, the base 250 of the insert abuts the internal wall that defines the bottom of the pocket 255 and the noted shoulder 254 abuts the shoulder seat 257. In this position (the "releasably mounted position"), the insert 249 is retained removably within the pocket 255 by virtue of the O-ring fitting snuggly (and being compressed) between an exterior sidewall of the insert and an interior sidewall of the stud's first head 211.

The stud 210 includes an insert removal access bore 258 extending from the face 259 of the second head 212, through the neck 213, and to the pocket 255 of the first head 211. Thus, when a person wishes to remove the insert 249, a narrow elongated object (e.g., a straightened paper clip) can be inserted into the bore 258 (by inserting such tool into the opening of bore 258 through the face 259 of the second head 212). Once a tip of the elongated tool comes into contact with the base 250 of the insert 249, the user applies force to the tool so as to push the insert out of the pocket, in the process forcing the O-ring 253 out of the O-ring receipt groove 266. The insert 249 is thus detached from the stud 210. If desired, another insert of like configuration but different ornamental appearance (e.g., of a different color) can then be mounted in the pocket.

Figure 14:
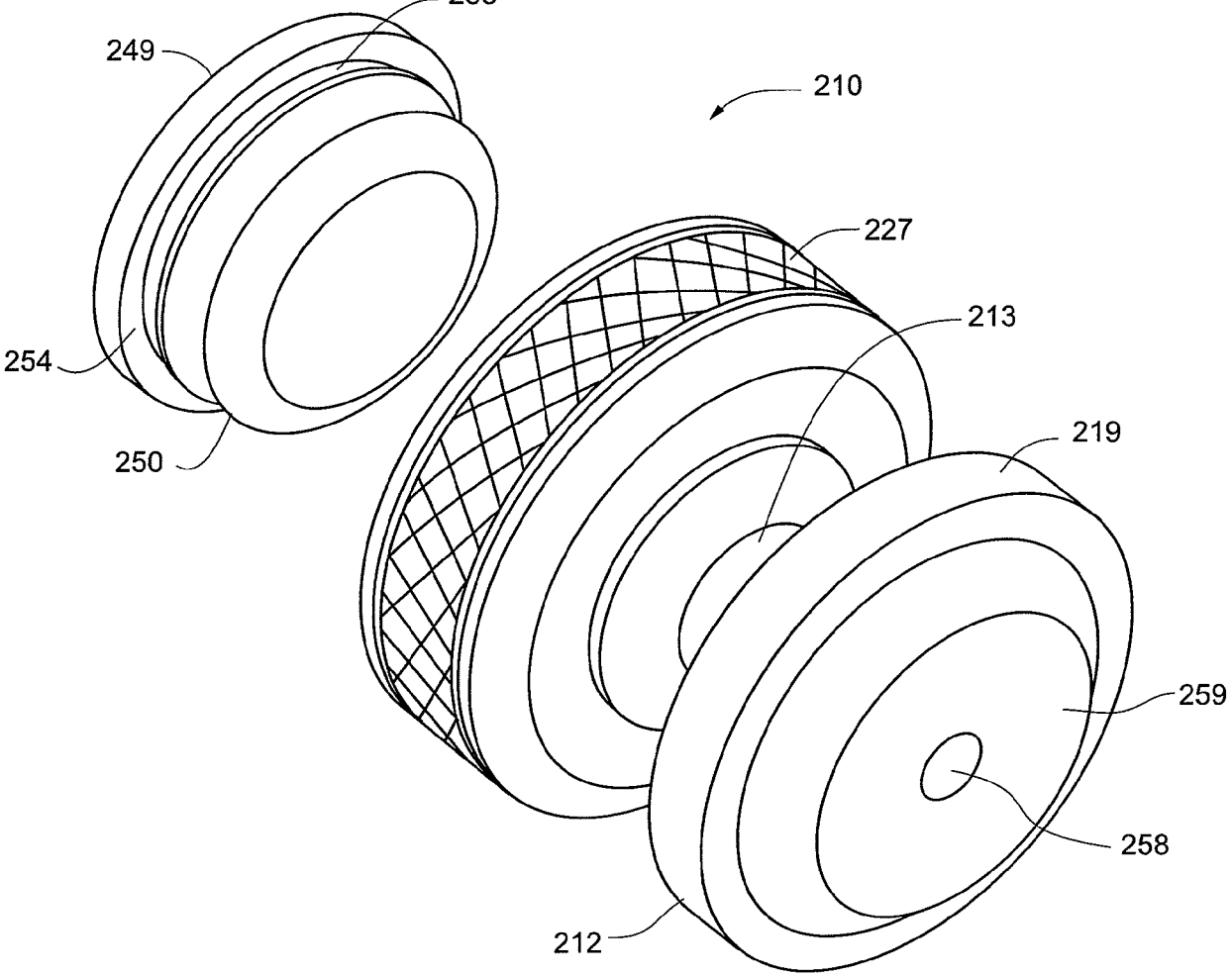
FIG. 14 illustrates another perspective view of a stud in accordance with the third embodiment, the removable decorative insert and the body of the stud being shown in a separated configuration.
Figure 20A:
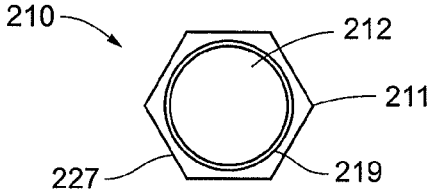
FIG. 20A is a back end view of a stud in accordance with certain embodiments of the invention.
Figure 20B:
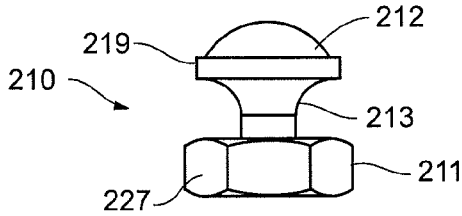
FIG. 20B is a side view of the stud of FIG. 20A.
Figure 21A:
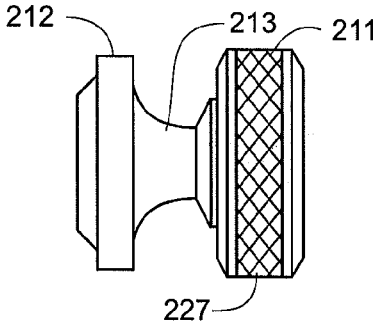
FIG. 21A is a side view of a stud in accordance with certain embodiments of the invention.
Figure 21B:
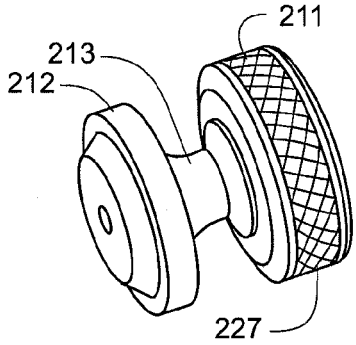
FIG. 21B is a back perspective view of the stud of FIG. 21A.
Figure 21C:
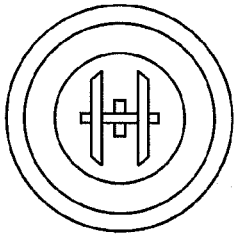
FIG. 21C is a front end view of the stud of FIG. 21A.
Figure 21D:
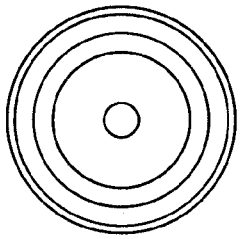
FIG. 21D is a back end view of the stud of FIG. 21A.

The first head 211 can have (e.g., define) an exposed side surface 227. Likewise, the second head 211 can have (e.g., define) an exposed side surface 219. In FIGS. 13 and 14, the side surfaces 219, 227 are ring-shaped surfaces. However, this is not required. For example, one or both of these surfaces can alternatively form a hexagonal shape or another polygonal shape. Reference is made to FIGS. 20A and 20B.

Figure 5:
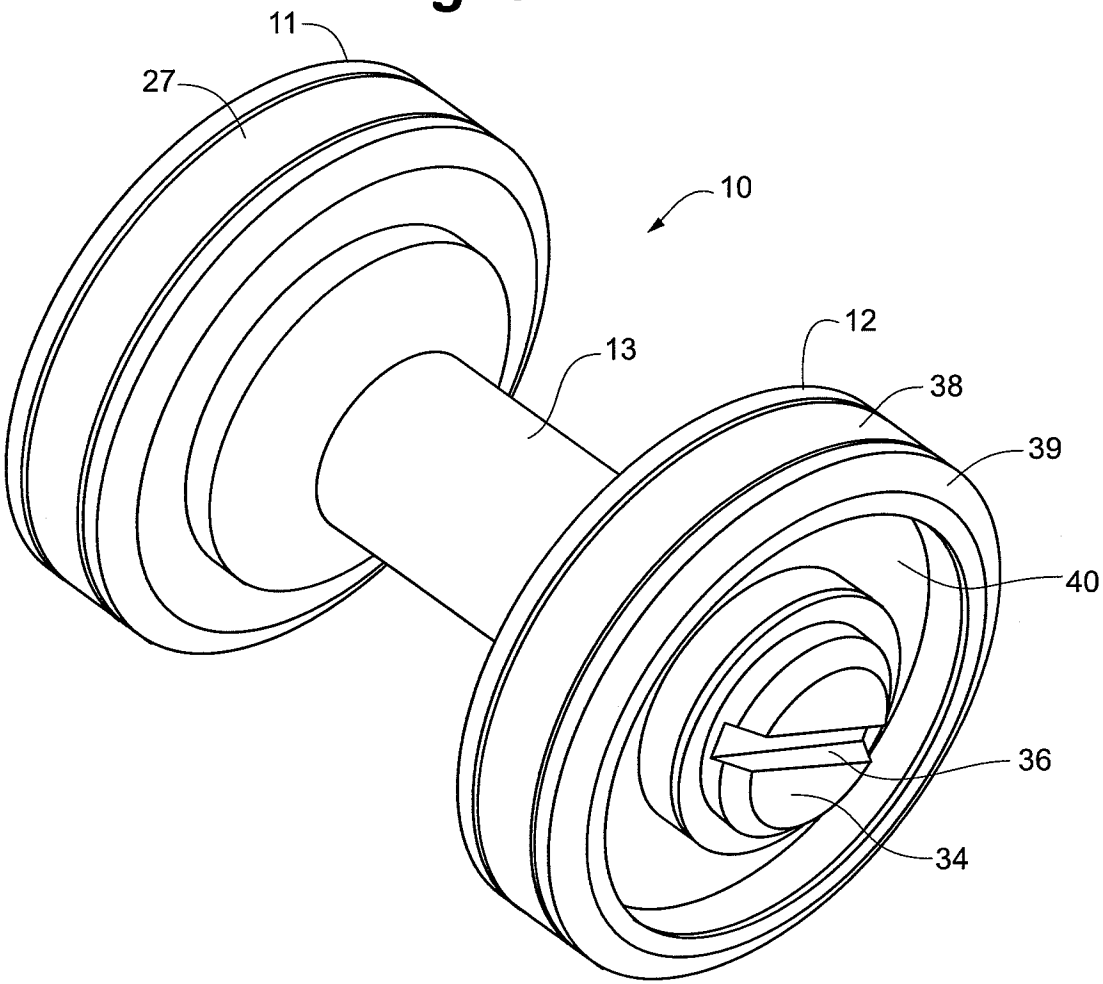
FIG. 5 illustrates a perspective view of a cufflink in accordance with the first embodiment, wherein the first and second heads are in a locked configuration.

If desired, one or both side surfaces 219, 227 can have a desired surface finish. In certain embodiments, the side surface 277 of the first head 211 has a three dimensional surface finish, whereas the side surface 219 of the second head 212 does not. For example, the side surface 227 of the first head 211 can optionally have a knurled finish. This provides the wearer with a surface that is easier to grip and also has a pleasing ornamental appearance. Many other surface finishes can be provided, e.g., the surface 227 can alternatively have a smooth finish (as shown in FIG. 5). In some cases, the side surfaces 219, 227 are defined by anodized aluminum or stainless steel. If desired, one or both side surfaces 219, 227 can have engravings, inlays, laser markings, emblems, indicia, etc. FIGS. 16A and 16B depict cufflinks having two hexagonal heads each with an engraving on its side surface. This type of engraving can likewise be provided on the side surface 227 of a stud's first head 212, if so desired.

In the illustrated stud 210 configuration, the two heads 211, 212 serve as a retention structure configured to retain the stud on a shirt such that two shirt regions, respectively defining two aligned stud holes, are retained between the first head 211 and the second head 212 while the neck is retained in a position in which it is extending through both of the aligned stud holes. In the present embodiment, the second head 219 is small enough to pass through a standard stud hole yet large enough to retain the stud on the shirt. The second head 212, for example, can be sized for use with stud holes of a predetermined size. Each stud hole has a length, and the second head 212 has an outer dimension (e.g., an outer diameter) that is smaller than the length of each stud hole. Preferably, the first head 211 is larger (e.g., has a larger diameter or other external dimension) than second head 212 and is too large to pass through the corresponding stud hole.

In FIGS. 11-14, the first 211 and second 212 heads of the stud 210 have a generally round exterior configuration (e.g., a generally circular exterior configuration taken in a cross section perpendicular to a central axis of the neck). The illustrated heads therefore each have an exterior diameter, as does the illustrated neck. The configuration of one or both heads, however, can take many different forms. For example, the first head 211 of the stud 210 can have a hexagonal shape, as shown in FIGS. 20A and 20B. Another possibility is that one or both heads have a generally square external configuration. If desired, the neck can also have a non-round configuration. Given the present teaching as a guide, it will be apparent to skilled artisans that the removable insert features (e.g., the O-ring or other resilient retention member(s), the pocket, and the insert removal bore extending through the neck of the stud) can be provided in studs of many different designs. These same features can likewise be provided in a cufflink having two large heads and a narrow central neck. Thus, the noted features can be provided in various stud and cufflink designs, and the present embodiment extends to any cufflink or stud having the present removable insert system.

Also claimed are the ornamental designs for the cufflinks and studs shown and described in the present disclosure.

Figure 16F:
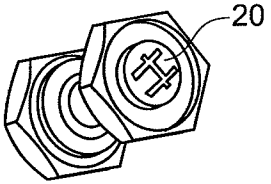
FIG. 16F is a front perspective view of a cufflink in accordance with certain embodiments of the invention.
Figure 16G:
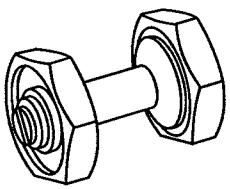
FIG. 16G is a back perspective view of the cufflink of FIG. 16F.
Figure 17C:
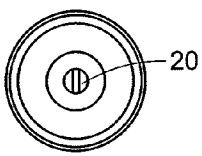
FIG. 17C is a front end view of the cufflink of FIG. 17A.
Figure 17F:
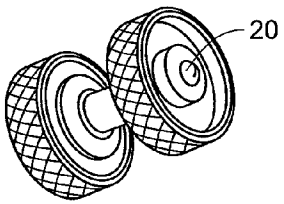
FIG. 17F is a front perspective view of the cufflink of FIG. 17A, the two halves being shown in a conjoined state.
Figure 17I:
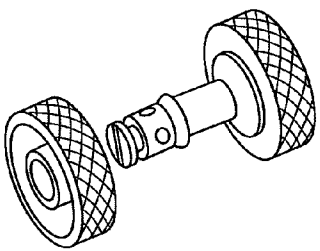
FIG. 17I is a back perspective view of the cufflink of FIG. 17I, the two halves being shown in a detached state.
Figure 17B:
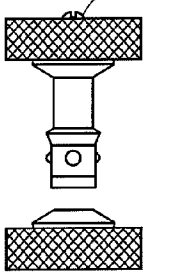
FIG. 17B is a side view of the cufflink of FIG. 17A, the two halves being shown in a detached state.
Figure 17E:
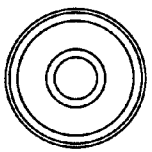
FIG. 17E is a back end view of the cufflink of FIG. 17A.
Figure 17H:
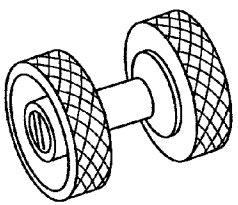
FIG. 17H is a back perspective view of the cufflink of FIG. 17A, the two halves being shown in a conjoined state.
Figure 17A:
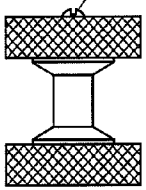
FIG. 17A is a side view of a cufflink in accordance with certain embodiments of the invention, wherein two halves of the cufflink are attached to each other.
Figure 17D:
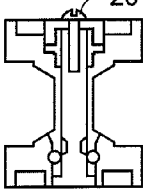
FIG. 17D is a cross-sectional side view of the cufflink of FIG. 17A.
Figure 17G:
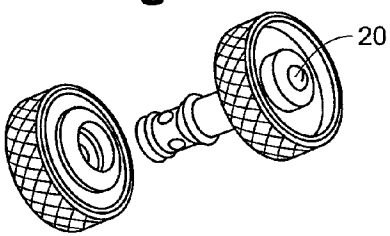
FIG. 17G is a front perspective view of the cufflink of FIG. 17A, the two halves being shown in a detached state.

FIGS. 16A-16G show a hexagonal head, long neck cufflink embodiment. Here, the cufflink has an actuator comprising a push button defined by a fastener 20, which has already been described. In FIG. 16F, the recessed logo can be considered to be shown in dotted lines (as not forming part of the claimed ornamental design). The same is true of the particular configuration of the push button/fastener 20 (particularly the screw driver slot). With respect to FIG. 16G, the same is true of the slot in the distal end of the shaft.

FIGS. 17A-17I show a round head, long neck cufflink embodiment. Here, the particular configuration of the push button/fastener 20 (particularly the screw driver slot) can be considered to be shown in dotted lines. With respect to FIGS. 17H and 17I, the same is true of slot in the distal end of the shaft.

Figure 18C:
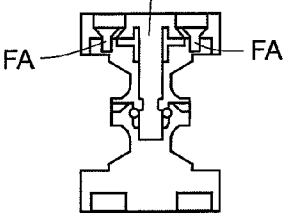
FIG. 18C is a cross-sectional side view of the cufflink of FIG. 18A.
Figure 18F:
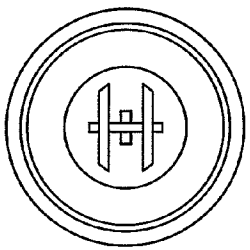
FIG. 18F is a front end view of a cufflink in accordance with certain embodiments of the invention.
Figure 18H:
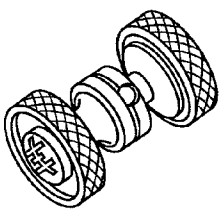
FIG. 18H is a back perspective view of the cufflink of FIG. 18F, the two halves being shown in a conjoined state.
Figure 18B:
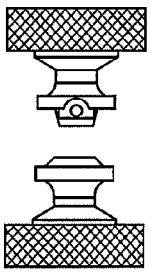
FIG. 18B is a side view of the cufflink of FIG. 18A, the two halves being shown in a detached state.
Figure 18E:
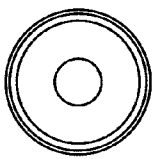
FIG. 18E is a rear end view of the cufflink of FIG. 18A.
Figure 18G:
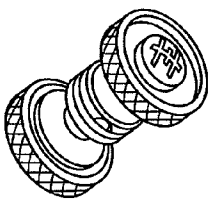
FIG. 18G is a front perspective view of the cufflink of FIG. 18F, the two halves being shown in a conjoined state.
Figure 18A:
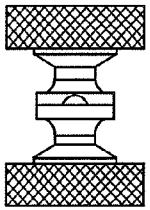
FIG. 18A is a side view of a cufflink in accordance with certain embodiments of the invention, the two halves being shown in a conjoined state.
Figure 18D:
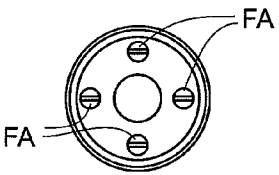
FIG. 18D is a front end view of the cufflink of FIG. 18A.

FIGS. 18A-18H show a round head, short neck cufflink embodiment. Here, the cufflink has an actuator comprising a push button defined by a plunger 131, which has already been described. In FIGS. 18C and 18D, the illustrated fasteners FA can be considered to be shown in dotted lines. The same is true of the semi-circular edge at the mating end of the neck that extends from the first head. Depending on the manufacturing method used, the opening defined by the illustrated semi-circular edge may or may not exist. With respect to FIGS. 18F-18H, the recessed logos can be considered to be shown in dotted lines.

Figure 19C:
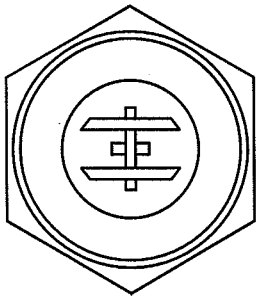
FIG. 19C is a front end view of the cufflink of FIG. 19A.
Figure 19B:
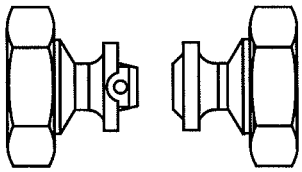
FIG. 19B is a side view of the cufflink of FIG. 19A, the two halves being shown in a detached state.
Figure 19E:
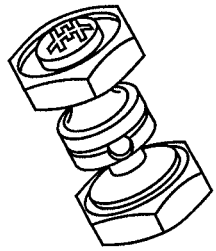
FIG. 19E is a back perspective view of the cufflink of FIG. 19A, the two halves being shown in a conjoined state.
Figure 19A:
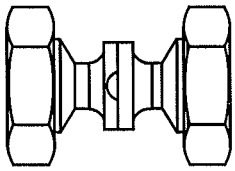
FIG. 19A is a side view of a cufflink in accordance with certain embodiments of the invention, the two halves being shown in a conjoined state.
Figure 19D:
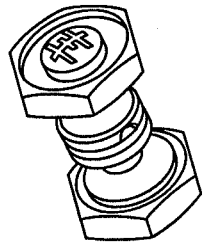
FIG. 19D is a front perspective view of the cufflink of FIG. 19A, the two halves being shown in a conjoined state.

FIGS. 19A-19E show a hexagonal head, short neck cufflink embodiment. Here again, the cufflink has an actuator comprising a push button defined by a plunger 131. In FIGS. 19C-19E, the recessed logos can be considered to be shown in dotted lines. The same is true of the semi-circular edge at the mating end of the neck that extends from the first head.

FIGS. 20A and 20B show a hexagonal head stud embodiment. FIGS. 21A-21D show a round head stud embodiment. Other views of this embodiment are shown in FIGS. 11-14, which have already been described.

The stud shown in FIGS. 11-14 can be made in the following exemplary way. The stud body and insert portions are turned from bar stock on manual or CNC lathes. Either of these components can alternatively be cold formed from coil steel, or at least partially requiring secondary machining as well as cast. Preferred materials for these components may be stainless steel, copper, and aluminum, although other materials such as carbon steel may be used. The parts can be electropolished after they are made to their finished form from one of the preceding methods; may be left in their raw state or finished in coatings such as anodizing, plating, vermeil, or physical vapor deposition among other finishes; and finally may or may not be laser marked with serial number, brand, and personalized information. O-rings are an off the shelf item, which can be purchased from, e.g., Precision Associates, Minneapolis, Minn. The aforementioned parts and subassembly are then assembled per the illustrations referenced.

In the foregoing detailed description, the invention has been described with reference to specific embodiments. However, it may be appreciated that various modifications and changes can be made without departing from the scope of the invention as set forth in the appended claims.

What is claimed is:

1. A cufflink having opposed first and second heads, wherein a shaft projects from the first head to a distal end region that is locked releasably to the second head, wherein a plunger is mounted for axial movement within and relative to the shaft, the plunger having a proximal end region and a distal end region, the proximal end region of the plunger being adjacent to the first head of the cufflink, the distal end region of the plunger being remote from the first head of the cufflink and being adjacent to the distal end region of the shaft, the plunger having a distal end and a shoulder stop, the plunger's shoulder stop being adjacent to the distal end of the plunger, the shoulder stop preventing movement of the plunger in a first axial direction when the shoulder stop engages a stop surface of the shaft's distal end region.

2. The cufflink of claim 1 wherein the shoulder stop is defined by an enlarged head at the distal end of the plunger, the enlarged head bearing against a distal end of the shaft when said movement of the plunger in said first axial direction is prevented.

3. The cufflink of claim 1 wherein the plunger is movable axially between a locked position and an unlocked position, the plunger being resiliently biased towards its locked position.

4. The cufflink of claim 3 wherein the cufflink includes a spring that biases the plunger toward its locked position, such that the plunger's locked position is a default position in which the plunger's shoulder stop is engaged with a distal end of the shaft, the distal end of the shaft defining said stop surface.

5. The cufflink of claim 3 wherein the cufflink comprises a ball lock mechanism that releasably locks the shaft to the second head, the ball lock mechanism comprising three or more balls that move to a locked configuration in response to the plunger moving to its locked position, the balls moving to an unlocked configuration in response to the plunger moving to its unlocked position.

6. The cufflink of claim 5 wherein the balls are carried by the shaft, and the second head has a generally annular configuration defining an internal opening in which the distal end region of the shaft is received, wherein an interior wall of the second head defines a ball-receipt groove into which the balls project.

7. The cufflink of claim 1 wherein the first head and the shaft are defined by a single integral body, and a push button is provided at a proximal end of the plunger, wherein said integral body defines a spring seat for a spring that biases the push button and the plunger toward a locked position.

8. The cufflink of claim 7 wherein the plunger and push button are joined together such that they move together axially relative to the shaft and the first head in response to a person pressing the push button.

9. The cufflink of claim 1 wherein the second head is defined by a single generally annular integral body, said body defining both an exterior side surface of the second head and an internal opening in which the distal end region of the shaft is received, said body having an interior wall defining a ball-receipt groove open to said internal opening.

10. A cufflink having first and second segments that are locked together releasably, the first segment comprising a first head, the second segment comprising a second head, the first segment including a first neck region projecting from the first head to a first distal end region, wherein a plunger is mounted for axial movement within and relative to the first neck region, the plunger having a proximal end region and a distal end region, the proximal end region of the plunger being adjacent to the first head of the cufflink, the distal end region of the plunger being remote from the first head of the cufflink and being adjacent to the distal end region of the cufflink's first segment, the plunger having a distal end and a shoulder stop, the plunger's shoulder stop being adjacent to the distal end of the plunger, the shoulder stop preventing movement of the plunger in a first axial direction when the shoulder stop engages a stop surface defined by the cufflink's first segment.

11. The cufflink of claim 10 wherein the second segment includes a second neck region projecting from the second head to a second distal end region, said first and second distal end regions being mated so as to releasably lock together the cufflink's first and second segments.

12. The cufflink of claim 11 wherein said first and second distal end regions are locked together releasably by a ball lock mechanism.

13. The cufflink of claim 12 wherein the first segment of the cufflink carries a plurality of balls, wherein said second distal end region defines an internal opening in which the balls and the distal end of the plunger are received, wherein an interior wall of said second distal end region defines a ball-receipt groove into which the balls project.

14. A cufflink having first and second segments that are locked together releasably, the first segment comprising a first head, the second segment comprising a second head, the first segment including a first neck region projecting from the first head to a first distal end region, wherein a plunger is mounted for axial movement within and relative to the first neck region, the plunger having a distal end adjacent to which a shoulder stop is provided, the shoulder stop preventing movement of the plunger in a first axial direction when the shoulder stop engages a stop surface defined by the cufflink's first segment, and wherein the shoulder stop is defined by an enlarged head at the distal end of the plunger, the enlarged head bearing against a ball retainer located at said first distal end region of the cufflink's first segment, the ball retainer carrying a plurality of balls that are part of a ball lock mechanism releasably locking together the cufflink's first and second segments.

15. The cufflink of claim 10 wherein the plunger is movable axially between a locked position and an unlocked position, the plunger being resiliently biased towards its locked position.

16. The cufflink of claim 15 wherein the cufflink includes a spring that biases the plunger toward its locked position, such that the plunger's locked position is a default position in which the plunger's shoulder stop is engaged with the stop surface defined by the cufflink's first segment.

17. The cufflink of claim 15 wherein the cufflink comprises a ball lock mechanism comprising three or more balls that move to a locked configuration in response to the plunger moving to its locked position, the balls moving to an unlocked configuration in response to the plunger moving to its unlocked position.

18. The cufflink of claim 10 wherein the first head, the first neck, and the first distal end region are all defined by a single integral body, and a push button is provided at a proximal end of the plunger, wherein said integral body defines a spring seat for a spring that biases the push button and the plunger toward a locked position.

19. The cufflink of claim 18 wherein the plunger and push button are joined together such that they move together axially relative to the first head and first neck in response to a person pressing the push button.

20. A cufflink, comprising:

a first head from which projects a shaft configured to extend through four aligned cuff holes in a cuff, wherein the shaft has a retention structure configured to temporarily retain the shaft and first head on the cuff such that two cuff end regions respectively defining the four cuff holes are retained between the retention structure and the first head;

a second head having a recess that extends through the second head; and the shaft having a distal end region configured to be locked releasably within the recess of the second head, wherein the retention structure is an integral projection of the shaft, wherein the retention structure comprises a raised retention ring projecting radially outward from the shaft, the retention ring being closer to the distal end region of the shaft than to the first head, and wherein the retention ring has first and second surface regions, the first surface region facing generally toward the first head, the second surface region facing generally toward the distal end region of the shaft, the first surface region being oriented at a steeper angle than is the second surface region such that the second surface region facilitates ready sliding of the two cuff end regions onto the shaft and past the retention ring, whereas the first surface region provides resistance to the two cuff end regions sliding off the shaft past the retention ring.

21. The cufflink of claim 20 wherein the cufflink comprises a ball lock mechanism configured to releasably lock the distal end region of the shaft within the recess of the second head.

22. The cufflink of claim 21 wherein the ball lock mechanism comprises a plurality of balls carried by the shaft, the raised retention ring on the shaft being located closer to the first head than are the balls of the ball lock mechanism.

23. A cufflink, comprising:

first and second heads configured to be releasably locked in a conjoint configuration by a mechanical lock mechanism;

the cufflink including an actuator to selectively lock and unlock the mechanical lock mechanism, the actuator being configured to move between locked and unlocked positions, the actuator comprising a push button, wherein the first head comprises a raised wall configured to protect the push button from inadvertent actuation, the push button being configured to move relative to said raised wall during locking and unlocking of the lock mechanism, the first head bounding a finger clearance space between the raised wall and the push button, said finger clearance space being sized and configured to receive therein a finger of a person when such person uses the finger to depress the push button.

24. The cufflink of claim 23 wherein the raised wall comprises a raised ring.

25. The cufflink of claim 24 wherein the finger clearance space is bounded by a recessed ring located radially inward of the raised ring, and wherein the push button is located radially inward of the recessed ring.

26. The cufflink of claim 25 wherein the push button is at a proximal end of a moveable plunger, the mechanical lock mechanism comprising a ball lock mechanism, wherein movement of the actuator between its locked and unlocked positions involves the push button and plunger moving axially relative to the raised ring.

27. The cufflink of claim 10 wherein the shoulder stop is defined by an enlarged head at the distal end of the plunger.

28. The cufflink of claim 10 wherein the cufflink includes a push button actuator, and the plunger is resiliently biased toward a default position in which the plunger's shoulder stop is engaged with the stop surface of the cufflink's first segment, the plunger being configured to move from its default position to an unlocked position in response to an operator pressing the push button actuator of the cufflink, thereby causing the plunger's shoulder stop to move away from said stop surface such that a gap results between the shoulder stop and the stop surface.

29. The cufflink of claim 1 wherein the first head and the shaft are defined by a single integral body, a push button is provided at a proximal end of the plunger, and the cufflink includes a spring that biases the push button and the plunger toward a locked position, said single integral body defining a spring seat for said spring.

30. The cufflink of claim 10 wherein the first head and the shaft are defined by a single integral body, a push button is provided at a proximal end of the plunger, and the cufflink includes a spring that biases the push button and the plunger toward a locked position, said single integral body defining a spring seat for said spring.

31. The cufflink of claim 1 wherein the cufflink has a plurality of ball-receipt grooves each formed in a wall defined by a machined component, not by a stamped component, each said wall having a wall thickness of at least 0.025 inch.

32. The cufflink of claim 10 wherein the cufflink has a plurality of ball-receipt grooves each formed in a wall defined by a machined component, not by a stamped component, each said wall having a wall thickness of at least 0.025 inch.

33. The cufflink of claim 1 wherein the plunger has a ball-receipt groove, the plunger having a larger diameter on one side of its ball-receipt groove than on the other side of that groove.

34. The cufflink of claim 33 wherein said larger diameter is on a proximal side of the plunger's ball-receipt groove, said proximal side being located between the plunger's ball-receipt groove and the cufflink's first head.

35. The cufflink of claim 10 wherein the plunger has a ball-receipt groove, the plunger having a larger diameter on one side of its ball-receipt groove than on the other side of that groove.

36. The cufflink of claim 35 wherein said larger diameter is on a proximal side of the plunger's ball-receipt groove, said proximal side being located between the plunger's ball-receipt groove and the cufflink's first head.

37. The cufflink of claim 10 wherein the cufflink includes a push button having a threaded connection to the plunger.

38. The cufflink of claim 23 wherein the cufflink includes a plunger having a threaded connection to the push button.

39. The cufflink of claim 38 wherein the push button is defined by a head of a fastener, the fastener having said threaded connection to the plunger.

40. The cufflink of claim 39 wherein the push button has an exposed face with an engraving, a recessed logo, or another stylized recess formed therein.

* * * * *